US010464805B2

(12) United States Patent
Cramm et al.

(10) Patent No.: US 10,464,805 B2
(45) Date of Patent: Nov. 5, 2019

(54) SOLVENT DISPENSING SYSTEM

(71) Applicant: Memorial University of Newfoundland, St. John's (CA)

(72) Inventors: Dennis Cramm, St. Philips (CA); Jason Stevens, St. Philips (CA)

(73) Assignee: Memorial University of Newfoundland, St. John's (CA)

( * ) Notice: Subject to any disclaimer, the term of this patent is extended or adjusted under 35 U.S.C. 154(b) by 21 days.

(21) Appl. No.: 15/373,755

(22) Filed: Dec. 9, 2016

(65) Prior Publication Data

US 2017/0190566 A1 Jul. 6, 2017

(30) Foreign Application Priority Data

Dec. 11, 2015 (CA) ..... 2914589

(51) Int. Cl.

| | |
|---|---|
| ***B67D 7/62*** | (2010.01) |
| ***B67D 7/02*** | (2010.01) |
| ***B67D 7/32*** | (2010.01) |
| ***B67D 7/54*** | (2010.01) |
| ***B67D 7/78*** | (2010.01) |
| ***F04B 43/073*** | (2006.01) |

(52) U.S. Cl.

CPC ..... *B67D 7/62* (2013.01); *B67D 7/0294* (2013.01); *B67D 7/3227* (2013.01); *B67D 7/54* (2013.01); *B67D 7/78* (2013.01); *F04B 43/0733* (2013.01)

(58) Field of Classification Search

CPC ... B67D 7/62; B67D 7/78; B67D 7/54; B67D 7/3227; B67D 7/0294; B67D 1/04; B67D 1/0412; F04B 43/0733

See application file for complete search history.

(56) References Cited

U.S. PATENT DOCUMENTS 2,102,140 A * 12/1937 Ungar ..... B67D 7/38 222/135
3,156,252 A * 11/1964 Johnston ..... B67D 1/0802 137/212
3,239,101 A * 3/1966 Wilson ..... B67D 1/0412 137/209

(Continued)

FOREIGN PATENT DOCUMENTS

FR 350559 A * 6/1905 ..... B67D 1/02

*Primary Examiner* — David P Angwin
*Assistant Examiner* — Bob Zadeh
(74) *Attorney, Agent, or Firm* — Wood Herron & Evans LLP

(57) ABSTRACT

Disclosed is a solvent dispensing system that includes a plurality of air-operated double diaphragm pumps, which are adapted to couple to a plurality of solvent supply containers, and coupled to a plurality of dispensing nozzles, wherein each air-operated double diaphragm pump is powered by a separate air supply line carrying pressurized air, and is controlled by a separate air directional control valve. The solvent dispensing system further includes a sealing cap device for coupling a solvent container to a solvent supply line. The sealing cap device is adapted to form a seal around a solvent discharge opening in a solvent container. The sealing cap device has a check valve and breather combination and a fitting for coupling the solvent container to a solvent supply line. Also disclosed is a clamping system for pressing the sealing cap device around the solvent discharge opening in the solvent container.

2 Claims, 36 Drawing Sheets

(56) References Cited

U.S. PATENT DOCUMENTS

| | | | | | |
|---|---|---|---|---|---|
| 3,256,907 | A * | 6/1966 | Clark | F16K 17/168 | 137/558 |
| 3,688,795 | A * | 9/1972 | Taylor | F16K 37/00 | 137/558 |
| 5,147,075 | A * | 9/1992 | Regan | F17C 7/00 | 222/402.15 |
| 5,511,692 | A * | 4/1996 | Willingham | B67D 1/0802 | 137/614.04 |
| 5,636,657 | A * | 6/1997 | Degenkolbe | B67D 1/0832 | 137/212 |
| 9,919,910 | B2 * | 3/2018 | Gibson | B67D 1/0406 | |
| 2006/0272740 | A1 * | 12/2006 | Poulter | B60P 3/2245 | 141/231 |
| 2007/0045447 | A1 * | 3/2007 | Wipper | B05B 9/0816 | 239/333 |
| 2011/0036414 | A1 * | 2/2011 | Paauwe | B67D 1/0412 | 137/12.5 |
| 2011/0278324 | A1 * | 11/2011 | Kilian | B67D 7/04 | 222/135 |
| 2014/0263470 | A1 * | 9/2014 | Wanless | B67D 7/0266 | 222/400.7 |
| 2015/0125318 | A1 * | 5/2015 | Tetzlaff | F04B 43/067 | 417/388 |
| 2017/0190566 | A1 * | 7/2017 | Cramm | B67D 7/0294 | |

* cited by examiner

SOLVENT DISPENSING SYSTEM

This application claims priority to Canada Patent Application No. CA 2,914,589, filed on Dec. 11, 2015.

FIELD OF THE INVENTION

The present invention relates to a solvent dispensing system, and more particularly to a solvent dispensing system that can dispense solvent from one or more large containers in a safe and controlled environment to prevent the risk of spills, fires, fumes, and explosions.

BACKGROUND OF THE INVENTION

Solvents are often packaged and sold in large containers containing a volume of solvent that exceeds the volume required for the immediate needs of a user. However, transferring a required volume of a solvent from a large container to a smaller container is fraught with difficulties. Large containers are difficult to handle due to their size, and handling large containers to remove a volume of liquid carries the risk of spills and the escape of dangerous fumes, which is a health, fire, and explosion hazard. Moreover, repeated access to the containers increases the risk of contaminating the material in the containers.

Several systems and methods for transferring solvents from large stock containers to smaller containers are known. However, many of the known systems are pressurized. The drawback of such pressurized systems is that the pressurized containers are hard to ship across international borders and must be returned to the supplier as they are quite expensive. Other known systems use electrical components, but with such systems there exists the possibility of electrical sparks from electrical components, which presents a serious problem, as the solvents being handled are highly flammable and any amount of spark can ignite them. In addition, many known systems rely heavily on the use of specialized components, which increases costs and impedes the implementation of such systems. A need therefore exists for a simple system which, where possible, uses off-the-shelf components, and which minimizes the risks and inconveniences of transferring solvents from large to smaller containers.

SUMMARY OF THE INVENTION

The present invention provides for a solvent dispensing system. In one aspect, the present invention provides for a solvent dispensing system comprising an air-operated double diaphragm pump adapted to being coupled to a solvent supply container and coupled to a dispensing nozzle for dispensing said solvent, said air-operated double diaphragm pump being powered by and coupled with a supply of pressurized air, and controlled by an air directional control valve.

In another aspect the present invention provides for a solvent dispensing system comprising a plurality of air-operated double diaphragm pumps, adapted to being coupled to a plurality of solvent supply containers, and coupled to a plurality of dispensing nozzles, wherein each air-operated double diaphragm pump is powered by a separate air supply line carrying pressurized air, and is controlled by a separate air directional control valve.

In yet another aspect, the present invention provides for a solvent dispensing system comprising a plurality of cabinets adapted for housing a plurality of solvent containers and housing a plurality of air-operated double-diaphragm pumps for pumping solvents from the solvent containers to a plurality of dispensing nozzles, an air manifold for distributing pressurized air to a plurality of air supply lines for powering the air-operated double-diaphragm pumps, a plurality of air directional control valves for controlling the air-operated double-diaphragm pumps, and a fumehood for housing the plurality of dispensing nozzles for dispensing a plurality of solvents.

More particularly, in one embodiment, the present invention provides a solvent dispensing system comprising: i) a manifold for supplying pressurized air, said manifold comprising an internal passage, an air entry port in communication with the internal passage, and at least one air discharge port in communication with the internal passage; ii) At least one selectively controllable air directional control valve, each directional control valve in communication with a corresponding air discharge port, iii) at least one air-operated double diaphragm pump, each said air-operated double diaphragm pump in communication with a corresponding air directional control valve; iv) at least one solvent container connecting means adapted for establishing a sealed constant pressure fluid communication between a solvent container and a corresponding air-operated double diaphragm pump; v) at least one solvent dispensing nozzle, each said solvent dispensing nozzle in fluid communication with a corresponding air-operated double diaphragm pump; vi) at least one solvent supply line, each said solvent supply line in a first section connecting a solvent container connecting means with the corresponding air-operated double-diaphragm pump, and in a second section connecting the air operated double diaphragm pump with the corresponding dispensing nozzle; vii) at least one air supply line, each said air supply line in a first section connecting an air discharge port with the corresponding air directional control valve, and in a second section connecting the air directional control valve with the corresponding air-operated double diaphragm pump; viii) at least one storage cabinet adapted for storing at the least one solvent container, each said storage cabinet comprising the at least one air-operated double diaphragm pump; and ix) a fumehood comprising the at least one dispensing nozzle for dispending solvents, wherein each air-operated double diaphragm pump is associated with one air directional control valve and is powered by pressurized air passing from the air manifold through the air directional control valve to the air-operated double diaphragm pump, and wherein upon activation of a particular air-operated double diaphragm pump, solvent passes from a corresponding container to the air-operated double diaphragm pump, and then to a corresponding dispensing nozzle.

In a further aspect, the present invention provides for a clamping system for pressing a sealing cap device around the solvent discharge opening in the solvent container. More particularly, in one embodiment the present invention provides a container clamping system comprising: i) a vertical bar having an upper portion and a bottom portion along its longitudinal axis, comprising a gear rack along the upper portion of the vertical bar, ii) a handle clamp assembly comprising a) a body in slideable engagement with the vertical bar along the portion containing the gear rack; b) a handle having a toothed pinion portion and a handle portion, the toothed pinion portion being rotatably mounted in the body of the handle clamp assembly, and in meshed engagement with the gear rack, wherein the handle is movable between an open and closed position, and wherein in the open position, the handle clamp assembly is at a first position along the vertical bar, and as the handle is moved to the closed position, the meshing of the pinion and gear rack causes the handle clamp assembly to move down the vertical bar to the second position; c) a means for securing the handle in the closed position; and d) a top clamping means; and iii) a foot connected to the bottom portion of the vertical bar, wherein the foot and the clamping means are adapted to applying a clamping force to an object there between.

In yet a further aspect, the present invention provides for a means of coupling a solvent container to a solvent supply line. The present invention provides for a sealing cap device for forming a seal around a solvent discharge opening in a solvent container, said sealing cap device having a check valve and breather combination and a means for coupling the solvent container to a solvent supply line. More particularly, in one embodiment the present invention provides a sealing cap device comprising: i) a container cap having a top and bottom surface, breather port and an opening, wherein the bottom surface is adapted to forming a seal around an opening in a container; ii) a cap top attached to the top surface of the container cap through at least one resilient spacer means; iii) a check valve in communication with a breather, said check valve coupled to the breather port; and iv) a tube secured in the opening in the container cap and extending away from the bottom and top surface of the container, wherein the sealing cap device is adapted to forming a seal around an opening in a container between the bottom surface of the container cap and the container upon an application to the cap top of a force sufficient to compress the at least one resilient spacer means.

In yet another aspect, the present invention provides a solvent dispensing system as noted above, wherein the at least one solvent container connecting means comprises a sealing cap device as noted above, wherein the sealing cap device forms a seal around an opening of a container between the top surface of a container and the bottom surface of the sealing cap device.

In yet a further aspect, the present invention provides a solvent dispensing system as noted above, further comprising at least one container clamping system as noted above, wherein the least one container clamping system in the closed position applies a clamping force between the bottom of a container and the cap top so as to compress the at least one resilient spacer means and form a seal around an opening of a container between the top surface of a container and the bottom surface of the sealing cap device.

BRIEF DESCRIPTION OF THE DRAWINGS

The embodiment of the invention will now be described, by way of example, with reference to the accompanying drawings in which.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
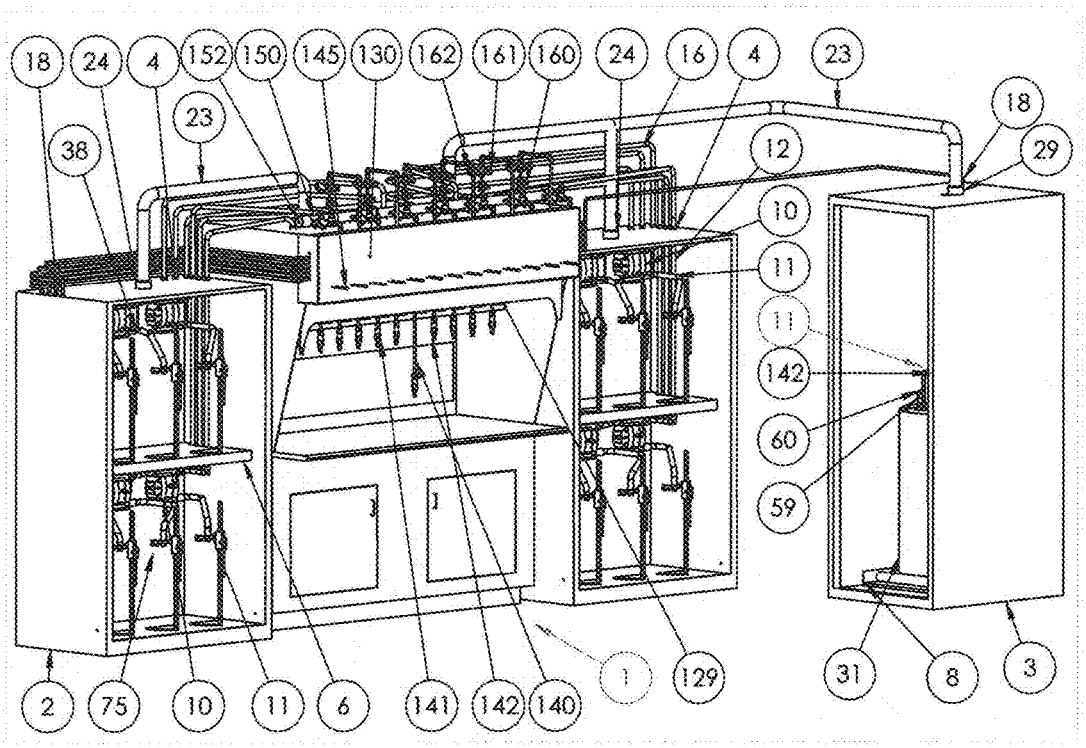
FIG. 1 shows an overall layout of the solvent dispensing system in accordance with one embodiment of the present invention.
Figure 2:
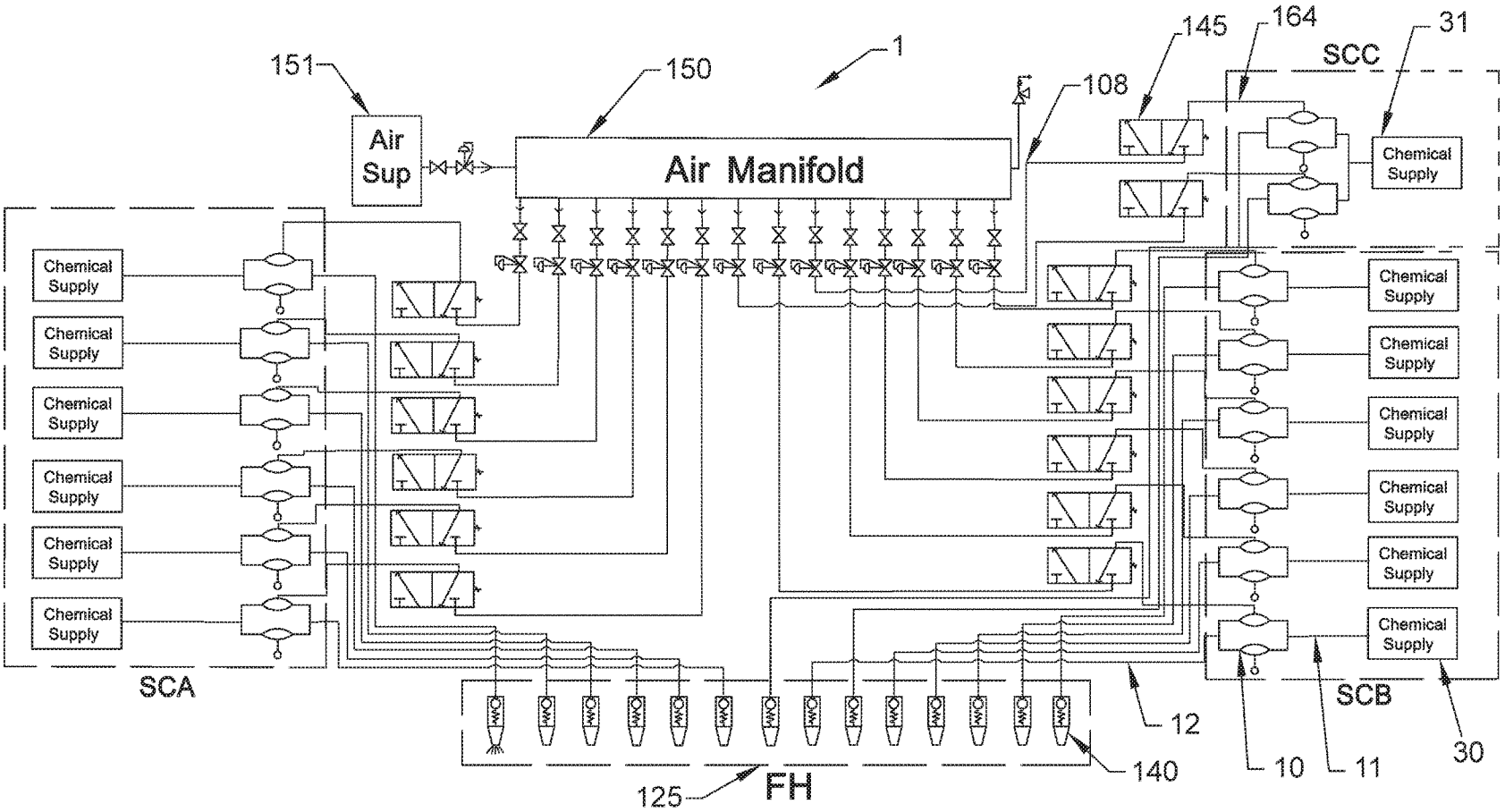
FIG. 2 is a simplified block diagram illustrating the solvent dispensing system in accordance with one embodiment of the present invention.
Figure 3:
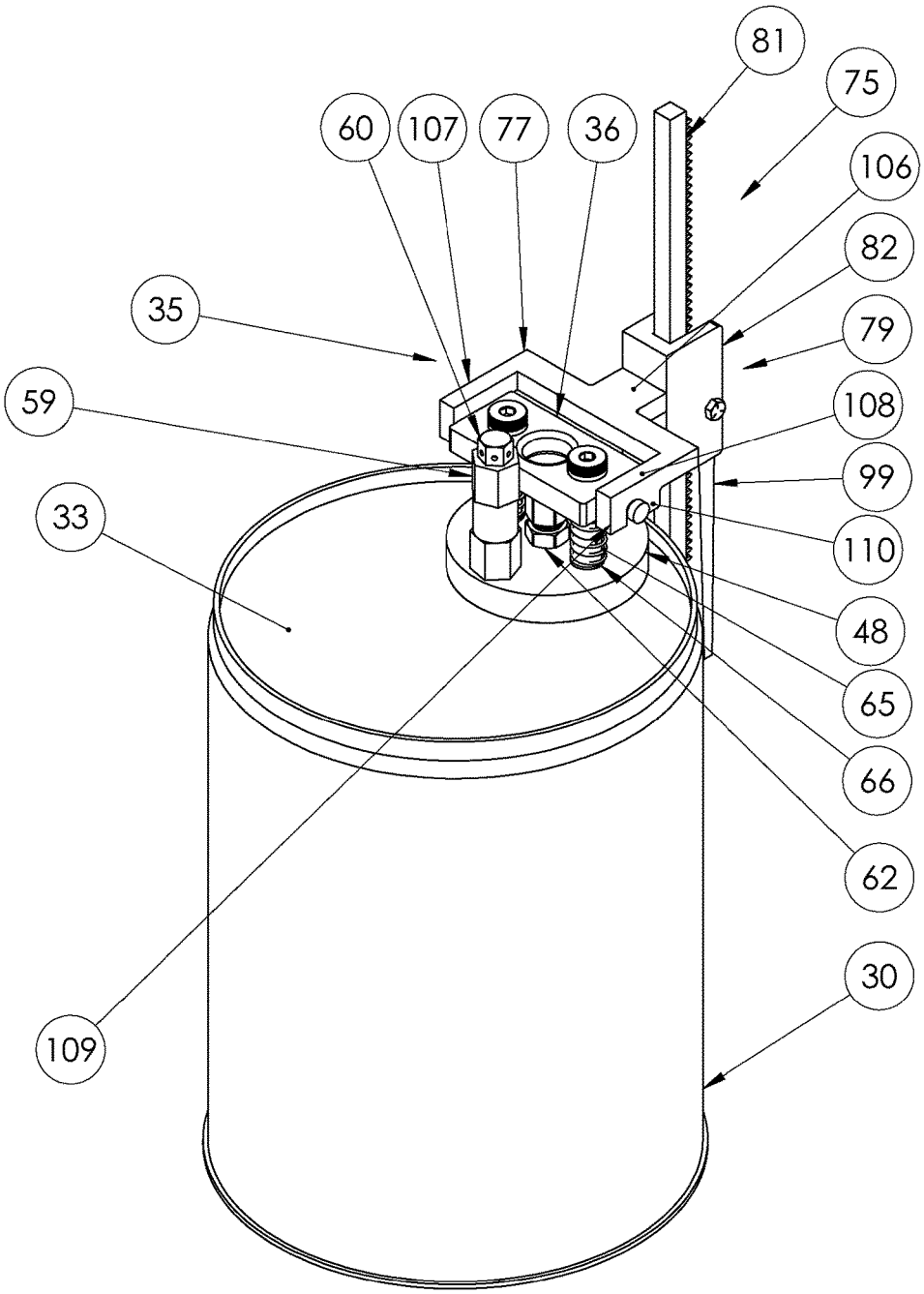
FIG. 3 is a perspective view of a container clamping system and a sealing cap device attached to a container in accordance with one embodiment of the present invention.
Figure 4:
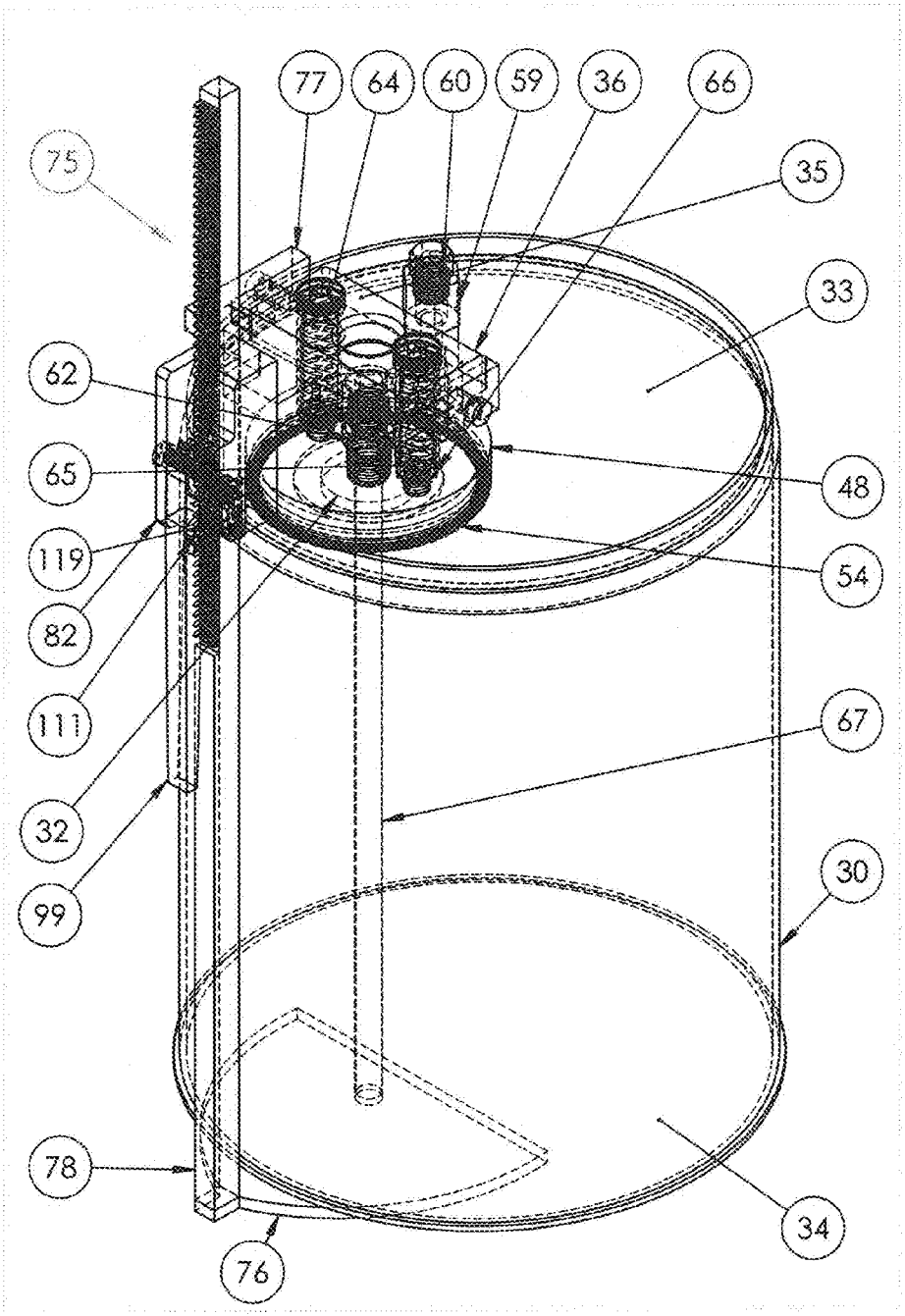
FIG. 4 is another perspective view a container clamping system and a sealing cap device attached to a container in accordance with one embodiment of the present invention.
Figure 5:
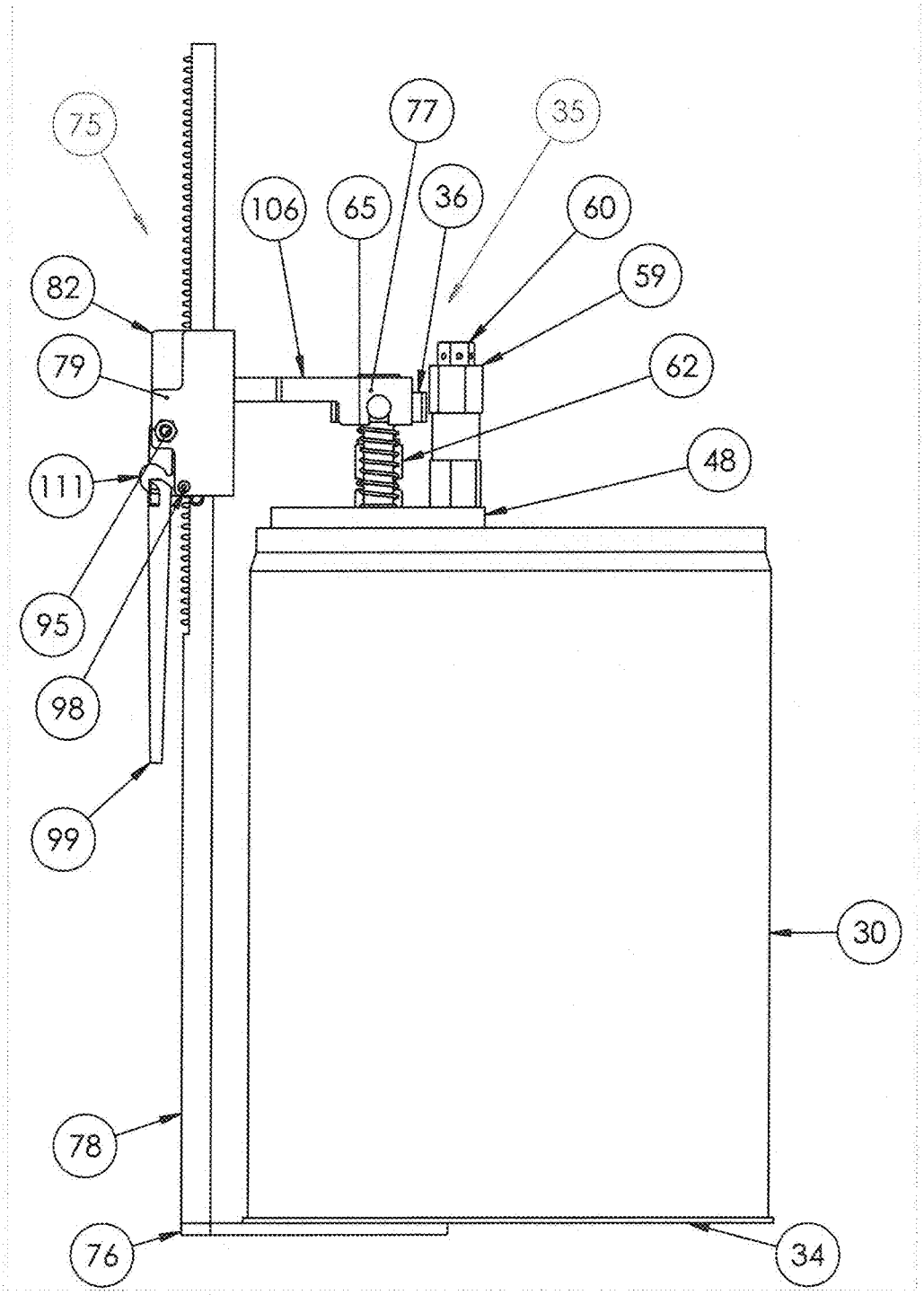
FIG. 5 is a side view of a container clamping system and a sealing cap device attached to a container in accordance with one embodiment of the present invention.
Figure 6:
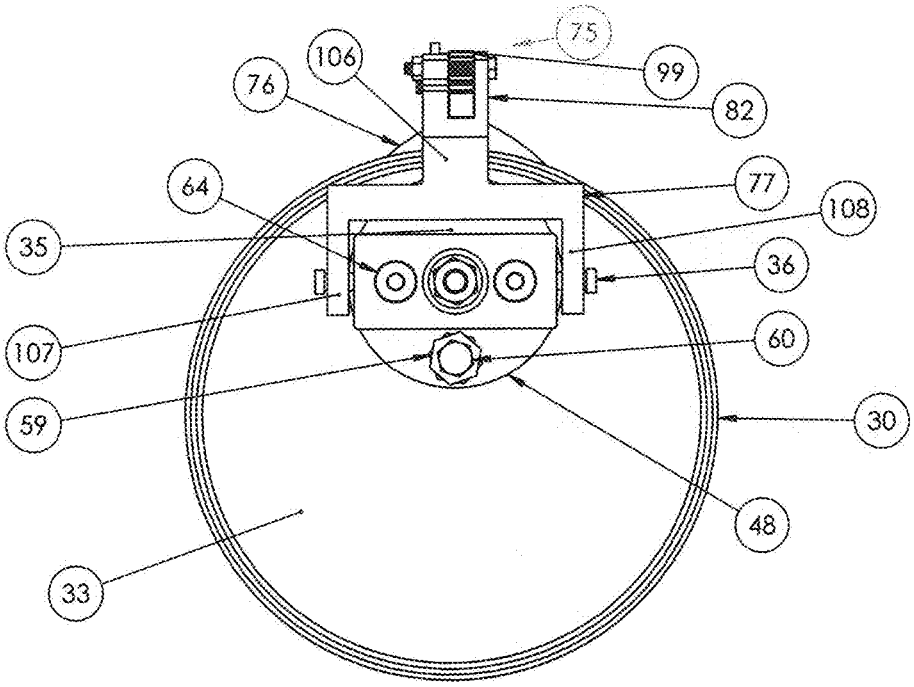
FIG. 6 is a top view of a container clamping system and a sealing cap device attached to a container in accordance with one embodiment of the present invention.

A preferred embodiment of a system for dispensing solvents 1 is illustrated in FIGS. 1 and 2. The system is adapted for distributing a solvent from a source of solvent such as a container 30, and comprises an air-operated double diaphragm pump 10, a dispensing nozzle 140, an air directional control valve 145, and a source of pressurized air 151. When system 1 is used with container 30, the container 30 is coupled to the air-operated double diaphragm pump 10 by way of a solvent supply line 11, and the air-operated double diaphragm pump 10 is coupled to the dispensing nozzle 140 by way of supply line 12.

The air-operated double diaphragm pump 10 is also coupled to the air directional control valve 145 by way of an air supply line 164. The air directional control valve is further coupled to a source of pressurized air by way of an air supply line 165. As discussed in detail further below, the air directional control valve 145 controls the operation of the air-operated double diaphragm pump 10 to control the flow of the solvent from the container 30 through the solvent supply line 11 and solvent supply line 12 to the dispensing nozzle 140.

In the embodiment illustrated in FIGS. 1 and 2, the system is adapted for distributing solvent from a plurality of containers 30 and large containers 31, and comprises a plurality of air-operated double diaphragm pumps 10, dispensing nozzles 140, solvent supply lines 11 and 12, air directional control valves 145, and air supply lines 164 and 165. In this embodiment, each container 30 and 31 is coupled to a corresponding air-operated double diaphragm pump 10 and a corresponding dispensing nozzle 140 through the corresponding solvent supply lines 11 and 12, and each air-operated double diaphragm pump 10 is coupled to a corresponding air directional control valve 145 through corresponding air supply lines 164 and 165, as to allow each air directional control valve 145 to control the flow of a solvent from a different container 30 or 31 to the corresponding dispensing nozzle 140. In this embodiment, each air supply line 165 is coupled to an air manifold 150 which is coupled to a source of pressurized air 151.

As illustrated in FIGS. 3 to 6, adapted to be positioned around the discharge opening 32 on the top surface 33 of the container 30 is a solvent container connecting means, such as a sealing cap device 35, forming a positive seal around the discharge opening 32. The sealing cap device 35 is adapted to be pressed against the top surface 33 of the container 30 by a clamping system 75 which vertically clamps the container 30 between a foot 76 and top clamp arms 77 thereof via the application of normal force through the foot 76 to the bottom surface 34 of container 30 and an opposing force through the top clamp arms 77 and the sealing cap device to the top surface 33 of container 30.

Figure 7:
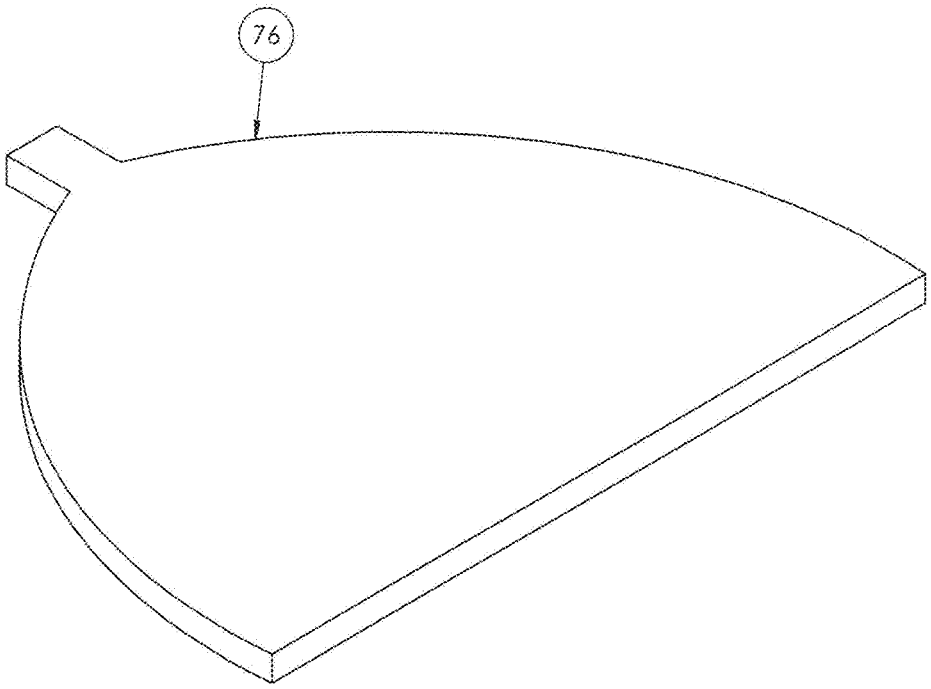
FIG. 7 is a perspective view of the foot of the container clamping system.
Figure 8:
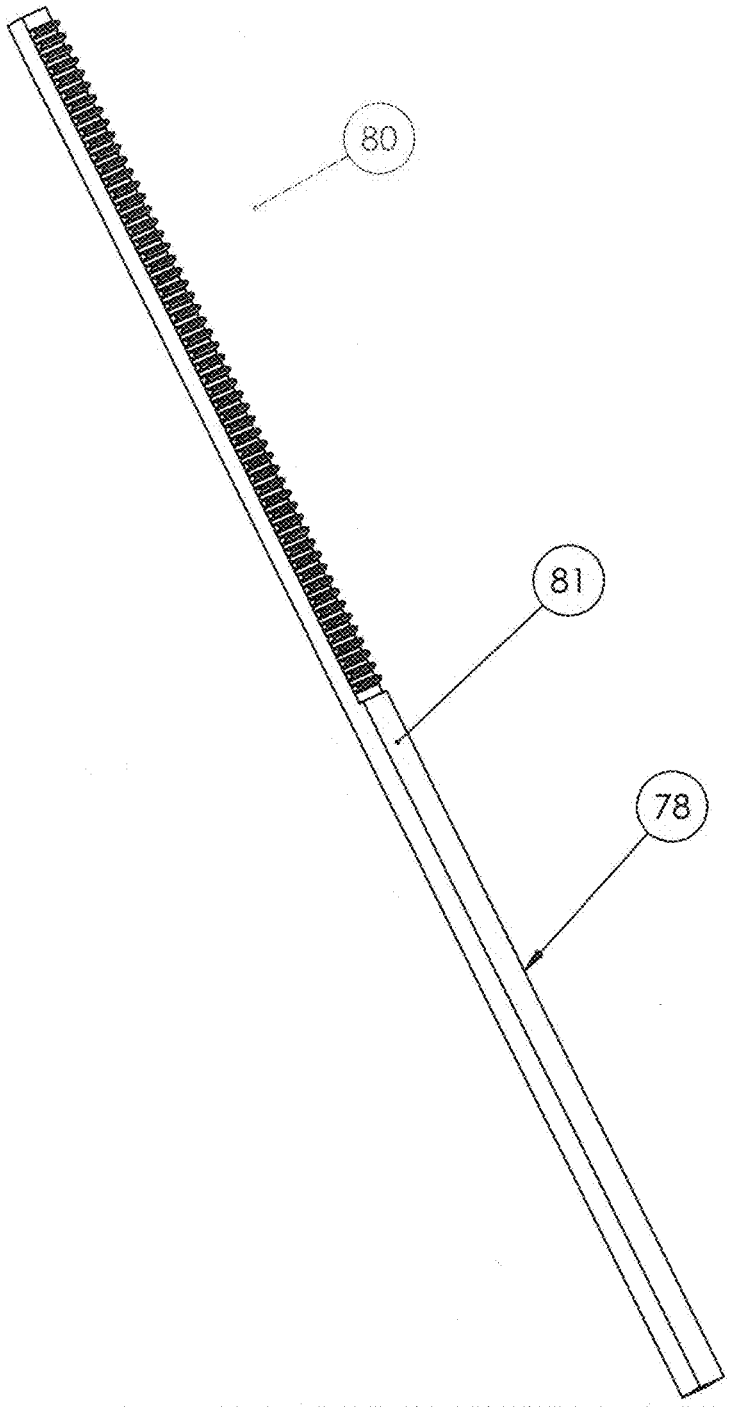
FIG. 8 is a perspective view of the vertical bar of the container clamping system.

The clamping system 75 shown in the embodiment illustrated in FIGS. 3 to 6, 32 and 33 has a foot 76, a vertical bar 78, a handle clamp assembly 79, and top clamp arms 77. The foot 76 is illustrated in more detail in FIG. 7, and is generally planar and rigidly connected to the bottom end of the vertical bar 78. The foot 76 is adapted for engaging the bottom surface 34 of container 30 and thereby provides a base for supporting container 30. As shown in FIG. 8, the vertical bar 78 preferably has four sides running parallel to its longitudinal axis (length) defining a generally square or rectangular cross-section through a plane perpendicular to the longitudinal axis of the vertical bar 78. The vertical bar 78 has a gear rack 80 along an upper portion of one side 81 of bar 78 that faces away from container 30 when engaged therewith, whereas the other sides of bar 78 are generally smooth.

Figure 12:
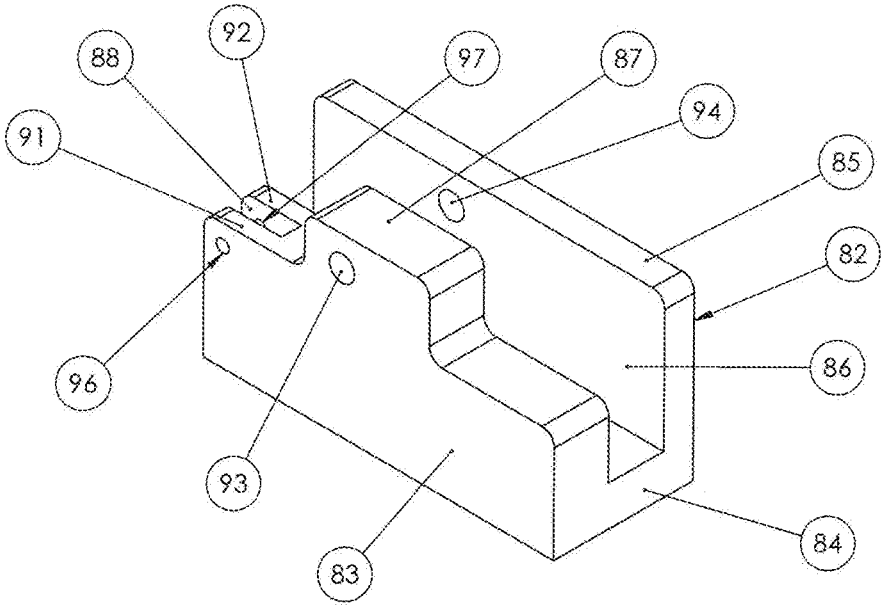
FIG. 12 is a perspective view of the handle clamp of the container clamping system.
Figure 13:
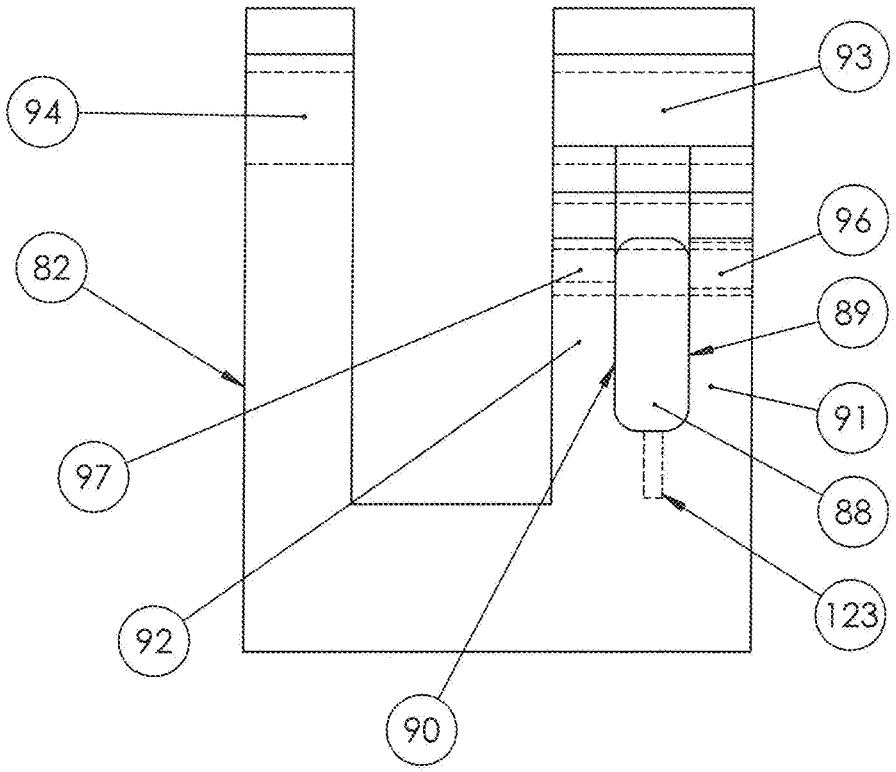
FIG. 13 is a side view of the handle clamp of the container clamping system.
Figure 32:
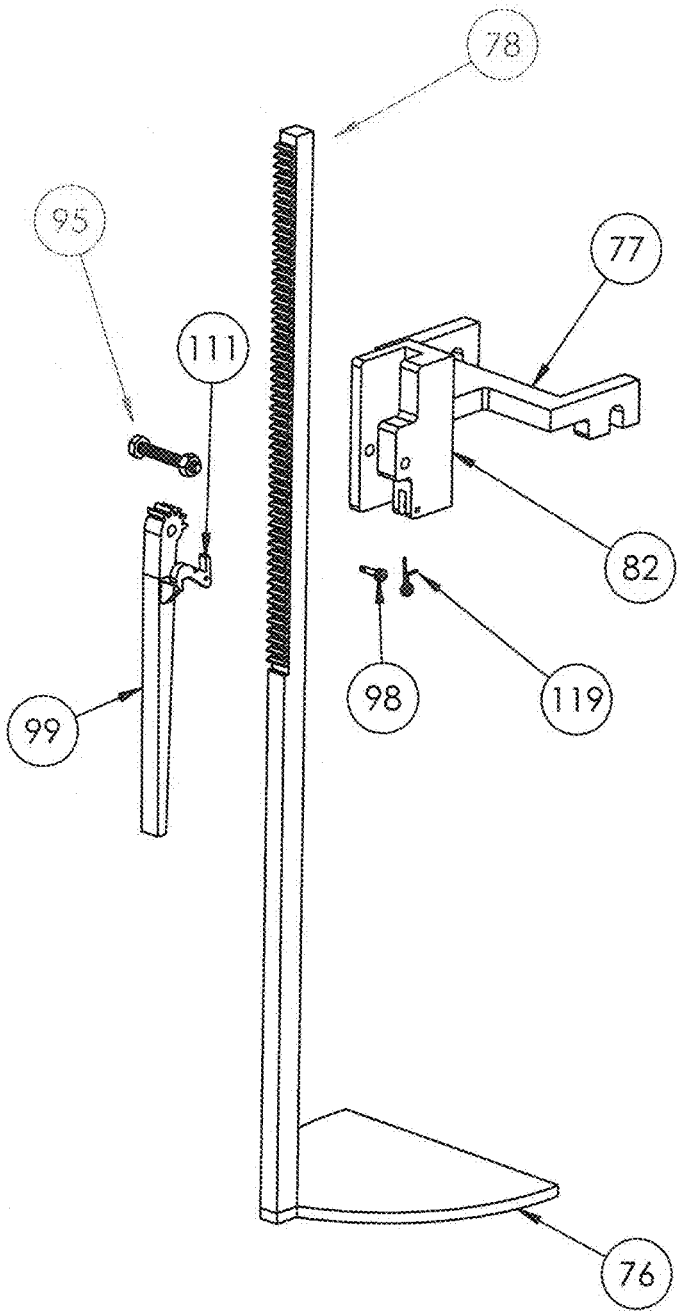
FIG. 32 is an exploded view of the container clamping system in accordance with one embodiment of the present invention.

The handle clamp assembly 79 has a handle clamp 82, as shown in FIGS. 12 and 13, having a first wall 83, a second wall 84, a third wall 85 and a channel 86 defined by the inner surfaces of the first wall 83, second wall 84 and third wall 85. The channel 86 is adapted for slideably engaging the vertical bar 78 along the portion containing the gear rack 80 of the vertical bar 78. The first wall 83 has a projection 87 and a slot 88. The slot 88 is defined by the inner surfaces 89 and 90 of walls 91 and 92 and is parallel to the plane of the first wall 83. The first wall 83 and the third wall 85 have openings 93 and 94 adapted to receive a handle shaft 95, as shown in FIG. 32. The walls 91 and 92 defining the slot 88 have openings 96 and 97 adapted to receive a snap hook shaft 98, also shown in FIG. 32.

Figure 9:
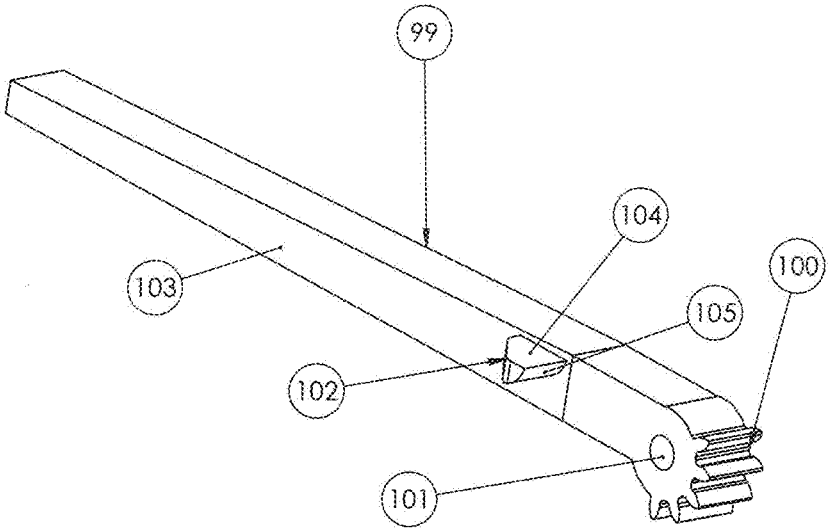
FIG. 9 is a perspective view of the handle of the container clamping system.
Figure 10:
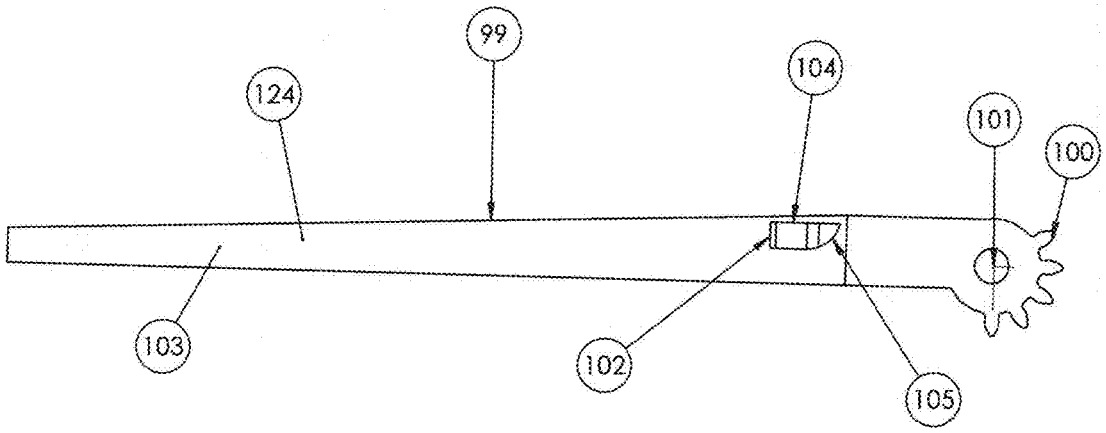
FIG. 10 is a side view of the handle of the container clamping system.
Figure 11:
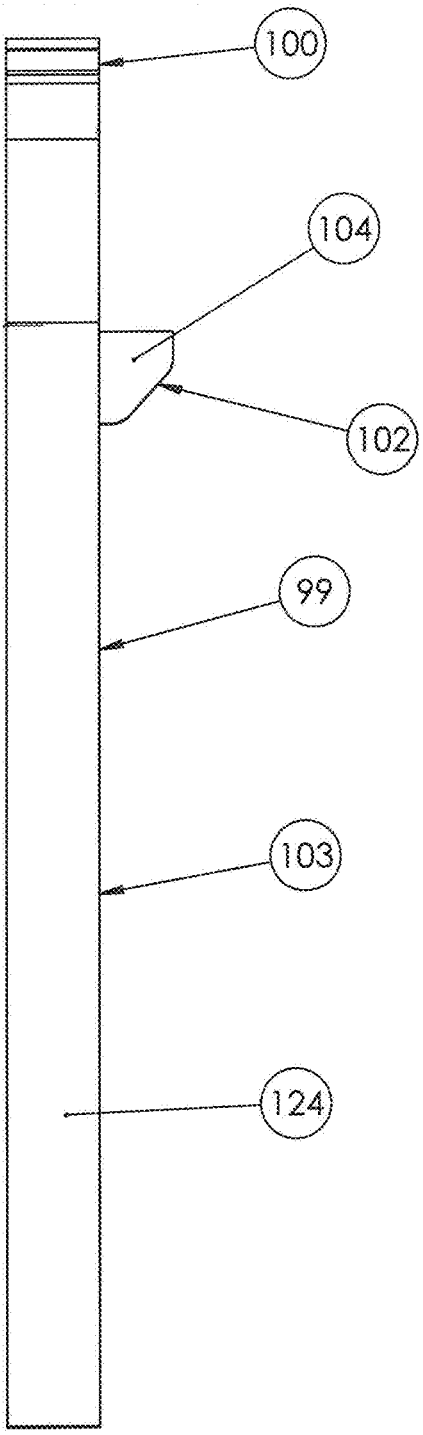
FIG. 11 is another side view of the handle of the container clamping system.

As shown in FIGS. 3 to 6, 32 and 33, a handle 99 is mounted in the handle clamp 82 as part of the handle clamp assembly 79. As shown in FIGS. 9 to 11, the handle has a toothed pinion portion 100 in a fixed relation to the handle portion 124 of the handle 99, and is adapted to mesh/couple with the gear rack portion 80 of the vertical bar 78. An opening 101 extends through the toothed pinion portion 100 and when the handle 99 is mounted in the handle clamp 82 the opening 101 accepts the handle shaft 95. The handle also has a tab 102 extending away from the side 103 of the handle. The tab 102 has a flat surface 104 and a rounded surface 105.

Figure 15:
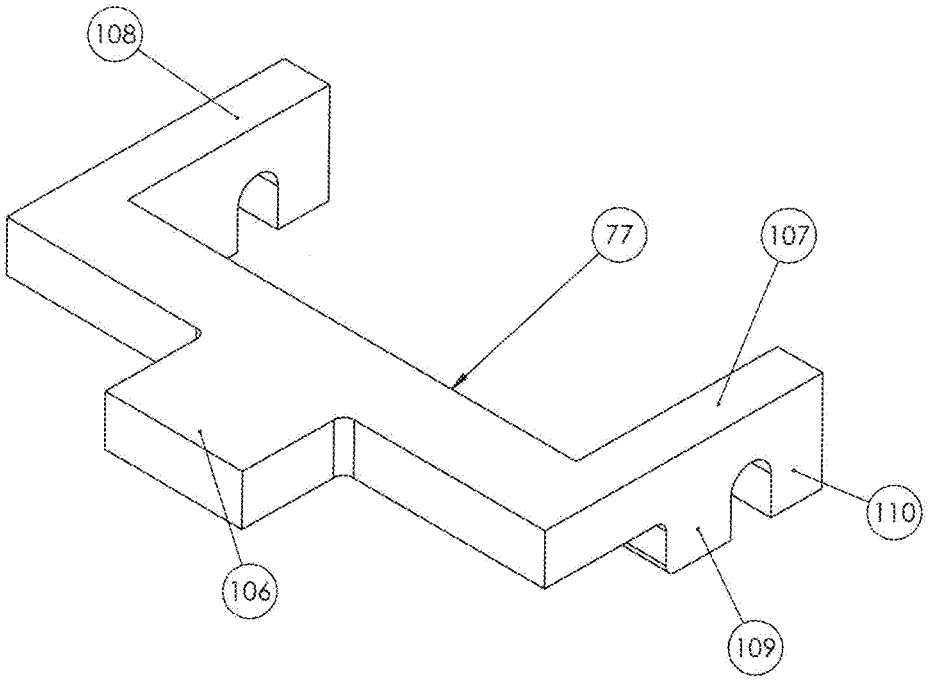
FIG. 15 is a perspective view of the top cap clamp of the container clamping system in accordance with one embodiment of the present invention.
Figure 19:
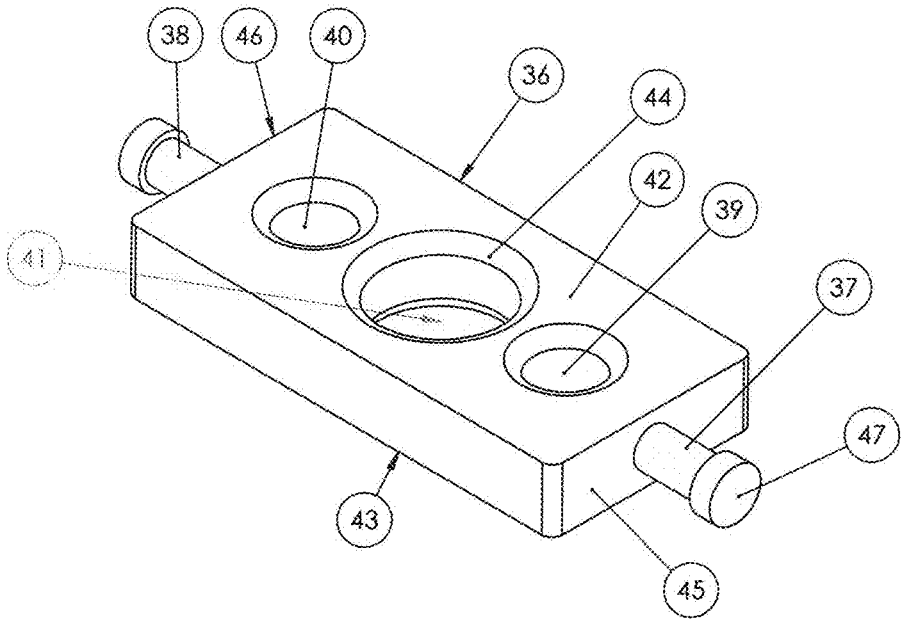
FIG. 19 is a perspective view of the cap top of the sealing cap device in accordance with one embodiment of the present invention.
Figure 20:
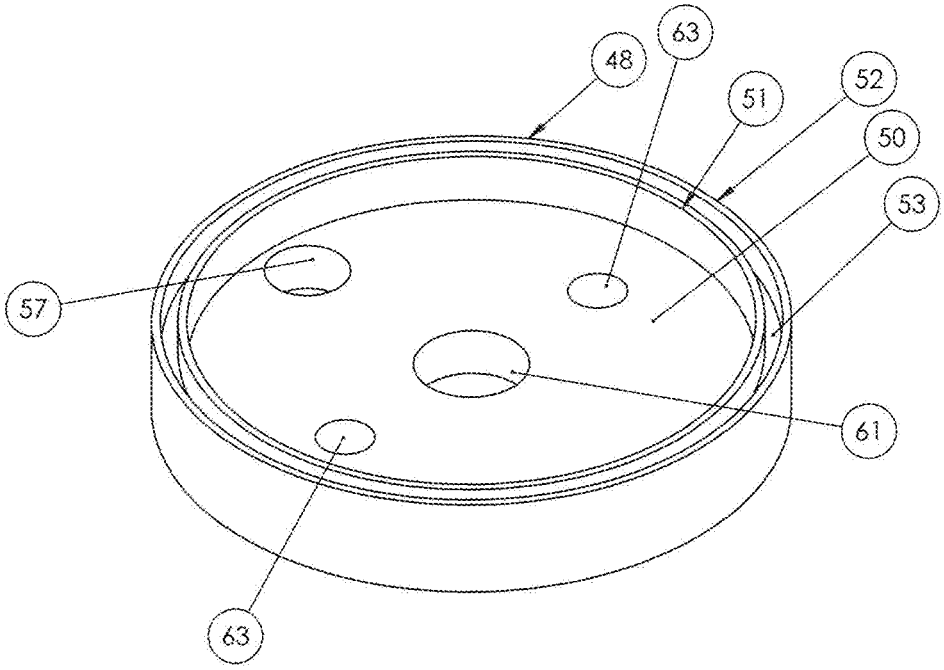
FIG. 20 is perspective view of the container cap of the sealing cap device in accordance with one embodiment of the present invention.

The handle clamp assembly 79 includes top clamp arms 77, as shown in FIG. 15, having a tab portion 106, and two arms 107 and 108 generally defining on three sides a rectangular void. Each arm 107 and 108 has a pair of fingers 109 and 110 defining a U-shaped channel adapted for accepting shafts 37 and 38 of a cap top 36 of the sealing cap device 35 as shown in FIG. 19. The top cap arms 77 are rigidly attached to the second wall 84 of the handle clamp 82 by tab 102 of handle portion 124.

Figure 14:
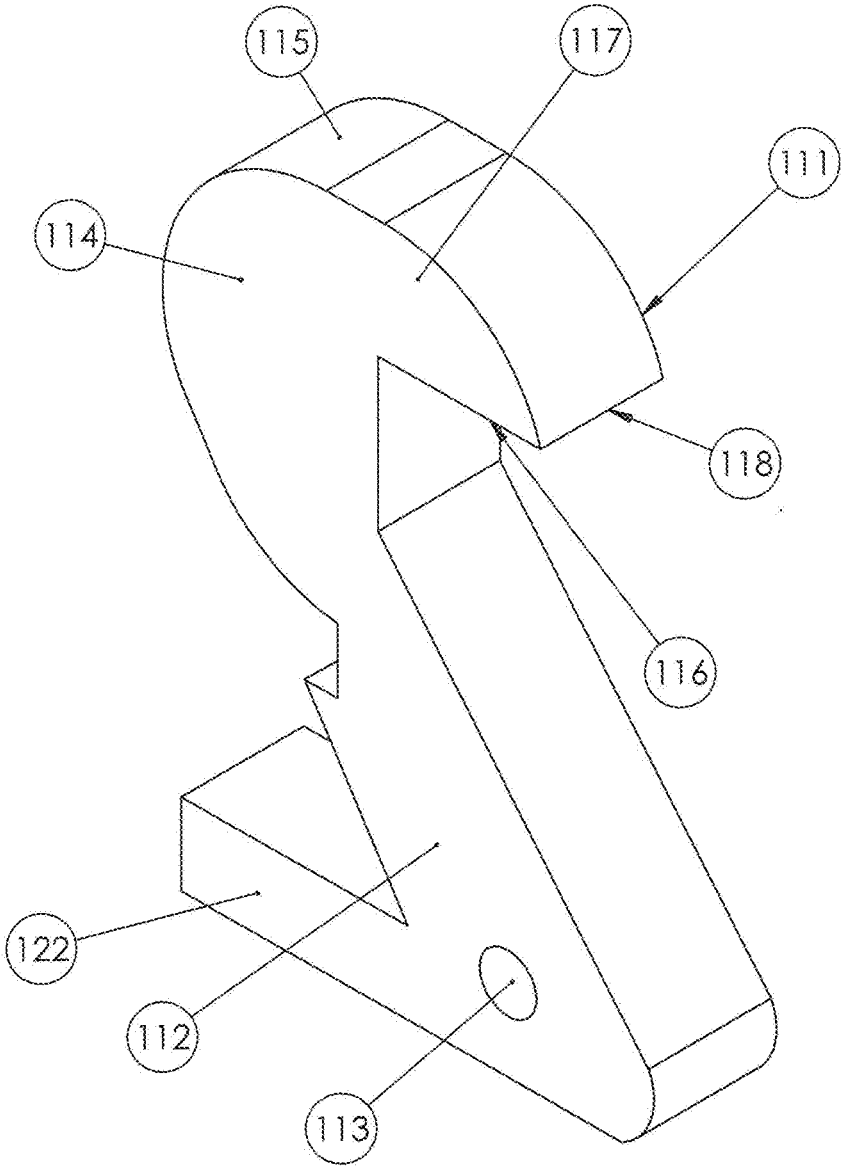
FIG. 14 is perspective view of the snap hook of the container clamping system.
Figure 24:
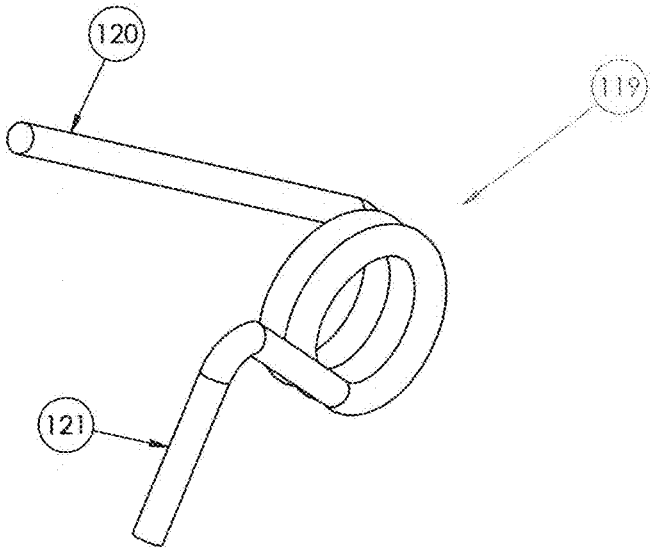
FIG. 24 is a perspective view of a torsion spring
Figure 25:
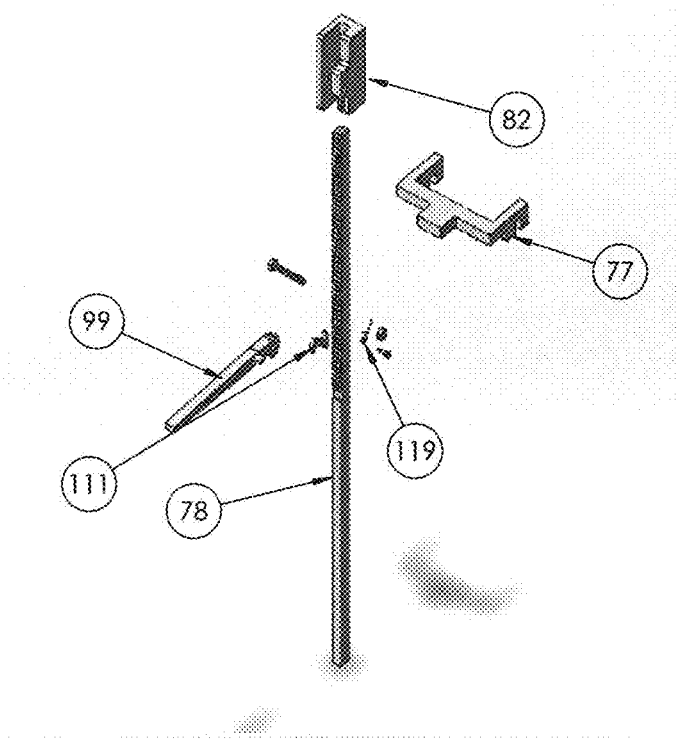
FIG. 25 is an exploded view of the handle clamp assembly in accordance with one embodiment of the present invention.
Figure 33:
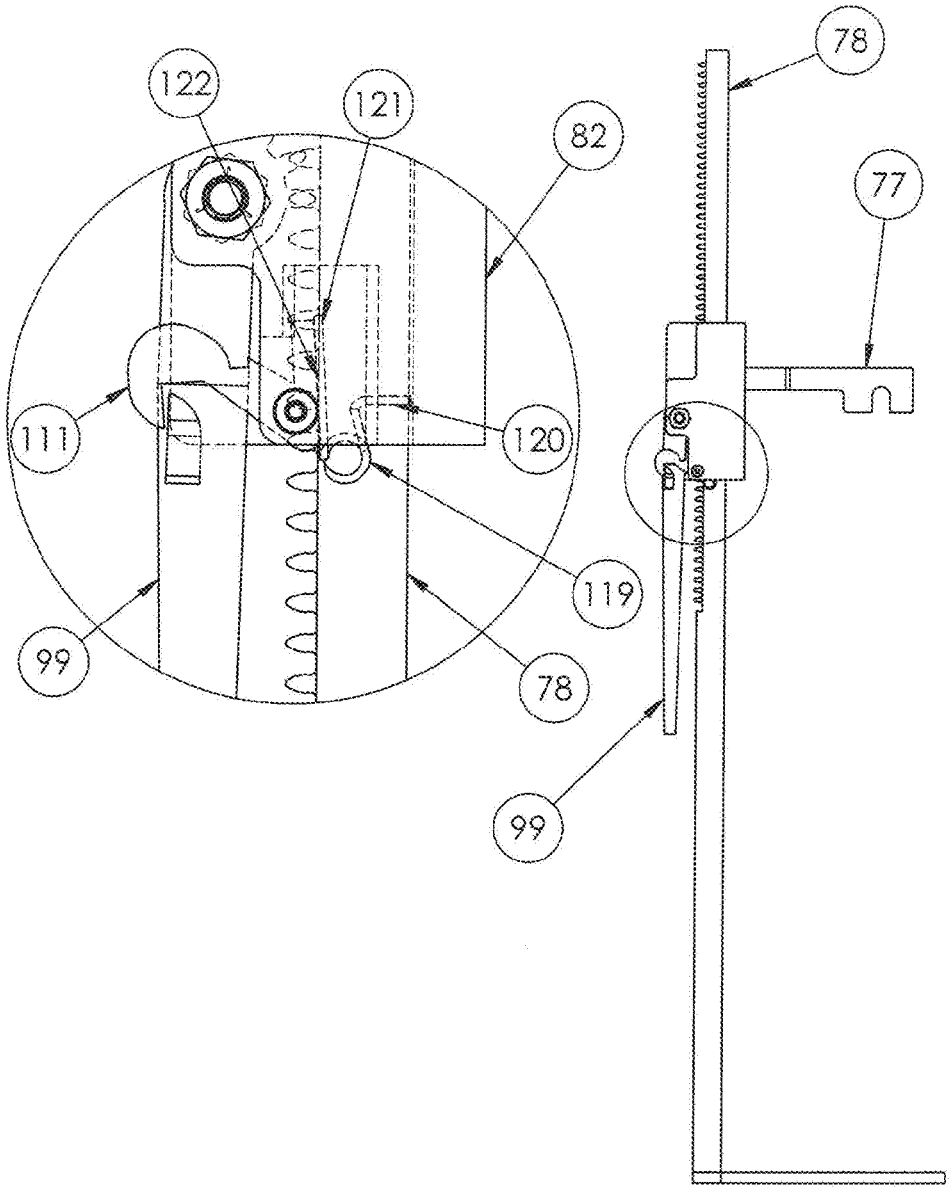
FIG. 33 is a side view of the container clamping system in accordance with one embodiment of the present invention showing a detail cross-section of the snap hook and torsion spring assembly.

The handle clamp assembly 79 also further includes a snap hook 111, as shown in FIG. 14. The snap hook 111 has a v-shaped portion 112 having an opening 113 through the elbow of the v-shaped portion 112. One arm of the v-shaped portion 112 ends in a rounded head portion 114 having a rounded surface 115 and a flat surface 116 defining a barb 117 and meeting at a front lip 118. The snap hook 111 is mounted on the snap hook shaft 98, as shown in FIG. 32, which passes through the opening 113 in the snap hook 111 and openings 96 and 97 in the handle clamp 82, as shown in FIG. 12. As shown in FIGS. 24, 32 and 33, a torsion spring 119 having arms 120 and 121 is used to apply force against an arm 122 of the v-shaped portion 112 of the snap hook 111. One arm 120 of the torsion spring 119 is inserted into opening 123 in the body of the handle clamp 82, and the rest of the torsion spring 119 is wedged under the snap hook 111 when the snap hook is installed in the handle clamp 82, so that arm 121 of the torsion spring 119 presses against arm 122 of the v-shaped portion 112 of the snap hook 111.

The handle 99 pivots around the handle shaft 95 between an open and closed position. The toothed pinion portion 100 of handle 99 couples with the gear rack 80 of the vertical bar 78. In the open position, the toothed pinion portion 100 is coupled with the gear rack 80 of the vertical bar 78 toward to the terminal portion of the gear rack 80. As the handle 99 is pivoted to the closed position around handle shaft 95, the toothed pinion portion 100 engages the gear rack 80 which results in the movement of the handle clamp assembly 79 in a downward direction along the longitudinal axis of the vertical bar 78 so as to enable the clamping of the container 30 between the foot 76 and the top clamp arms 77.

As the handle 99 is moved from the open to the closed position, the rounded surface 105 of tab 102 comes in contact with the rounded surface 115 of a snap hook 111, as shown in FIG. 14. As the handle 99 continues moving toward the closed position, the tab 102 pushes the snap hook 111 upwards against the resistance of the torsion spring 119 until the snap hook 111 lifts enough for the tab 102 to slide under the barb 117 of the snap hook 111. As the handle 99 is moved further toward the closed position, the tab 102 moves past the front lip 118 of the snap hook 111 and the snap hook 111 locks into place around the tab 102 by being pushed down by the torsion spring 119 around the tab 102 so that the flat surface 104 overlaps the flat surface 116 on the snap hook 111 securing the handle 99 in the closed position. To release the handle 99, the snap hook 111 is lifted to a position where the flat surface 104 does not overlap the flat surface 116 on the snap hook 111, at which point the handle 99 may be moved away from the closed position to a position wherein the tab 102 is past the snap hook 111.

Figure 21:
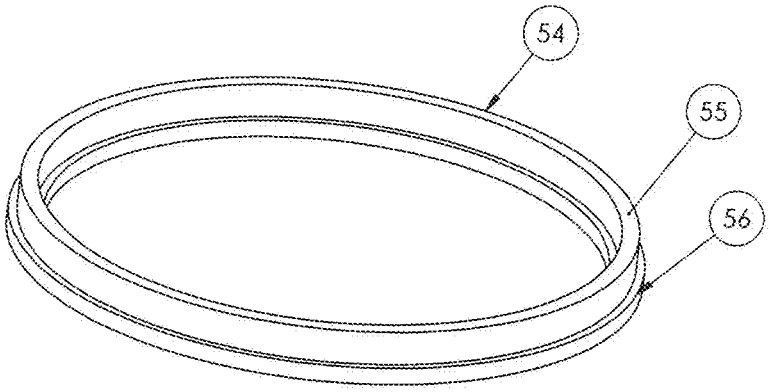
FIG. 21 is a perspective view of a Teflon O-ring of the sealing cap device in accordance with one embodiment of the present invention.
Figure 22:
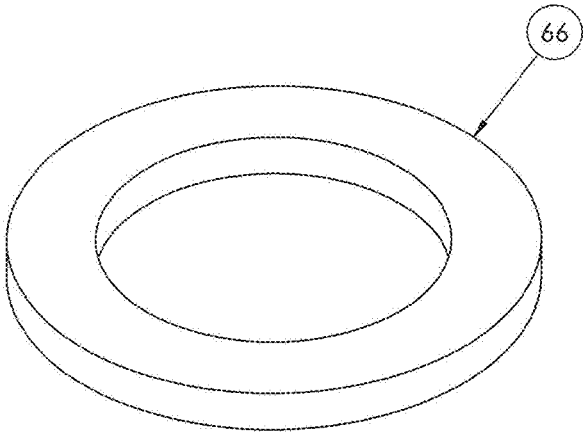
FIG. 22 is a perspective view of a Teflon seal of the sealing cap device in accordance with one embodiment of the present invention.

The sealing cap device 35 is illustrated in detail in FIGS. 18 to 23 and includes a container cap 48 having a top surface 49 and bottom surface 50. The bottom surface 50 is recessed with respect to walls 51 and 52 (see FIG. 20). Wall 51 bounds the inner perimeter of the sealing cap device 35 and extends away from bottom surface 50. The walls 51 and 52 are separated by a space and form a channel 53 there between. Fitted into channel 53 is a Teflon O-ring 54, as shown in FIG. 21, having a smaller portion 55 for fitting into channel 53 and a larger portion 56 for engaging and forming a seal around the discharge opening 32 of container 30 to prevent vapors from escaping. The O-ring 54 has a labyrinth machined into the bottom surface that contacts container 30 to allow for deformation of the Teflon to create a seal between the sealing cap device 35 and the top of the container 30 or 31.

Figure 23:
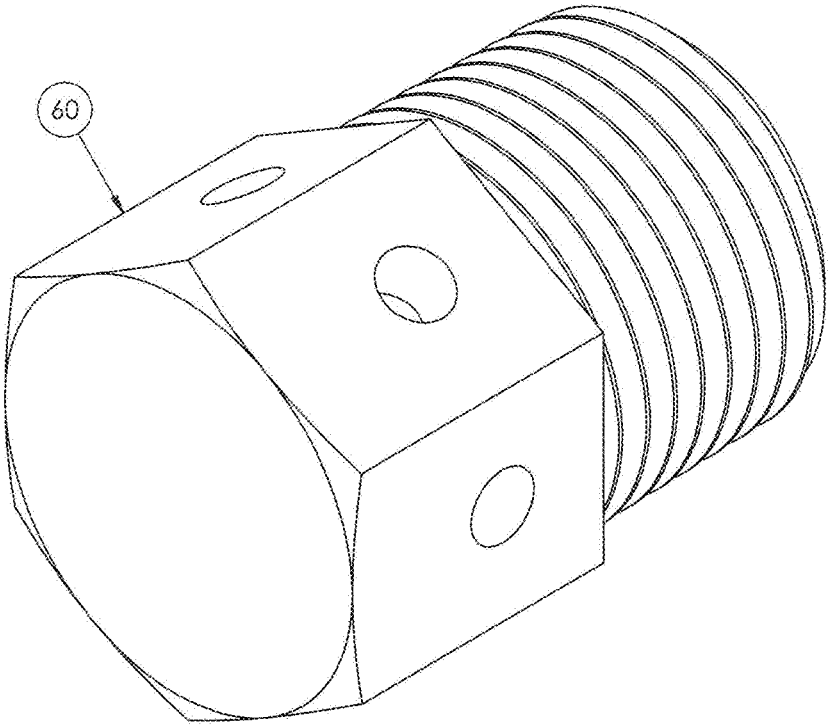
FIG. 23 is a perspective view of a male breather of the sealing cap device in accordance with one embodiment of the present invention.

The container cap 48 has a threaded breather port 57 extending through the body of the container cap 48. A threaded nipple is screwed into the threaded breather port 57, and a check valve 59 (preferably ⅓ psi cracking pressure) is screwed onto the other end of the threaded nipple. While not shown, a male check valve may be screwed directly into the threaded port 57. A male breather 60, as shown in FIG. 23, is screwed in the other end of the check valve 59. The check valve 59 and breather 60 work together to prevent the occurrence of negative pressure in the container that would otherwise be created as the solvent is being removed by the action of the air-operated double diaphragm pump 10. The check valve 59 allows air to enter the container 30 as solvent is being removed out of it, and the breather 60 stops debris from entering the container through the check valve 59.

The container cap 48 also includes a threaded opening 61. A tube 67 slides through a compression fitting 62 which is then tightened to hold the tube 67 in place. The compression fitting 62 securing the tube 67 is then screwed into the threaded opening 61. The tube 67 extends from the bottom surface 50 of the container cap 48 to near the bottom of the container 30 or 31, and extends a short distance from the top surface 49 of the container cap 48. A compression fitting 68 is mounted at the end of the tube 67 above the container cap 48. The container cap 48 also has two threaded openings 63 for accepting shoulder bolts 64.

The sealing cap device 35 further includes the cap top 36 shown in FIG. 19. The cap top 36 is generally planar and has two small openings 39 and 40 and one larger opening 41. Each such opening extends through the top surface 42 and bottom surface 43, and has a bevelled edge 44. The cap top 36 also has two shafts 37 and 38 extending from opposite sides 45 and 46 respectively of the cap top 36 and are generally in line with each other. The end portion of each shaft 37 and 38 has a larger diameter than the rest of the shaft, forming a head 47.

Figure 18:
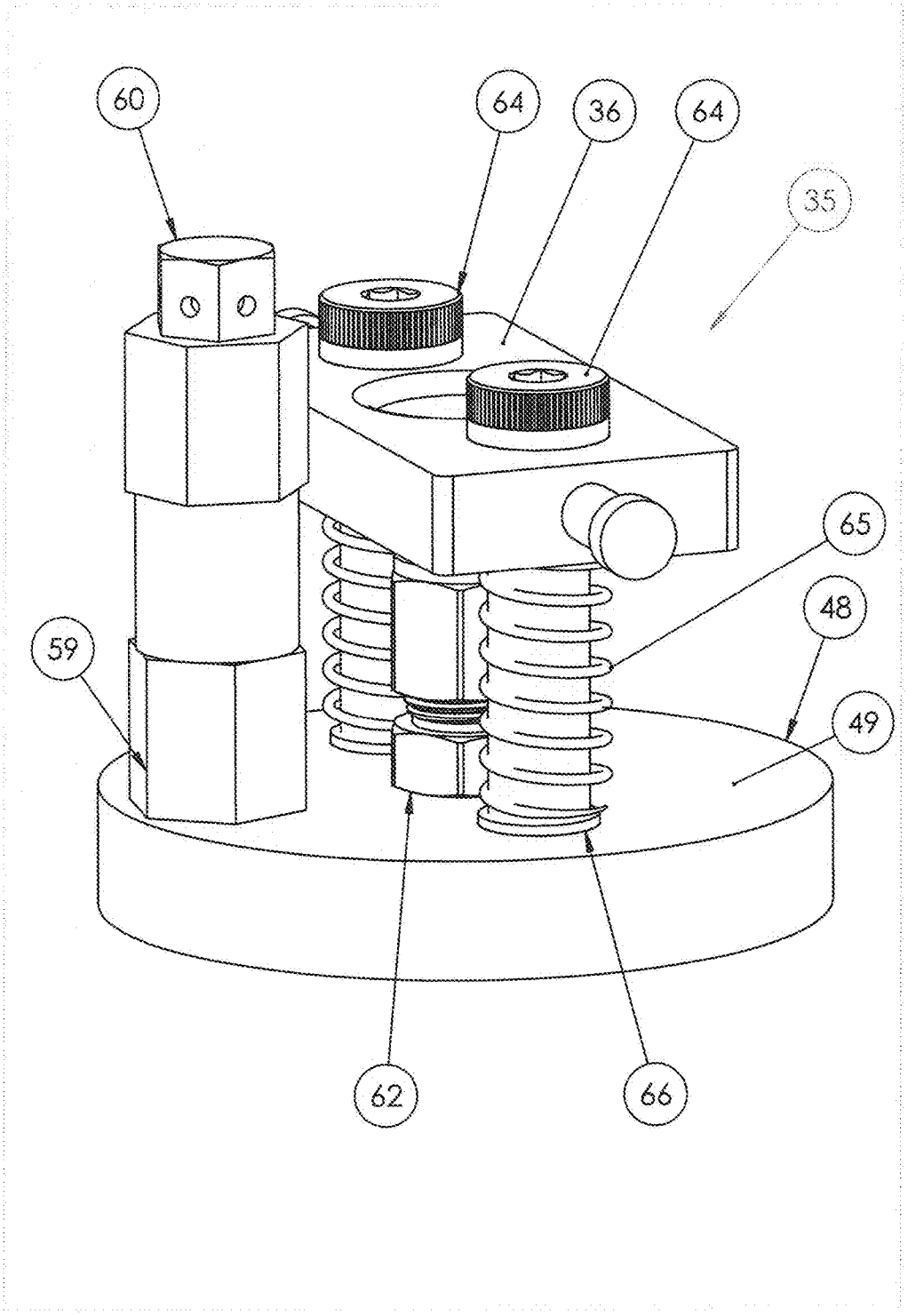
FIG. 18 is a perspective view of a sealing cap device in accordance with one embodiment of the present invention.

As illustrated in FIG. 18, when the sealing cap device 35 is assembled, the shoulder bolts 64 pass slideably through the small openings 39 and 40 in the cap top 36. Resilient spacer means, such as compression springs 65, and Teflon washers 66 are slideably fitted around each shoulder bolt 64, and the shoulder bolts 64 are screwed into the threaded openings 63 in container cap 48. When assembled, the cap top 36 is thereby positioned on top of compression springs 65.

When used with the clamping system 75, the sealing cap device 35 is positioned around the discharge opening 32 of the container 30 with the bottom surface of the Teflon O-ring 54 engaging the top surface 33 of the container 30 around the discharge opening 32. The U-shaped channels of the top clamp arms 77, as defined by the fingers 109 and 110, project downward from the top cap arms 77 to engage the shafts 37 and 38 of the cap top 36 between the heads 47 so that heads 47 limit lateral movement of the cap top 36.

Figure 16:
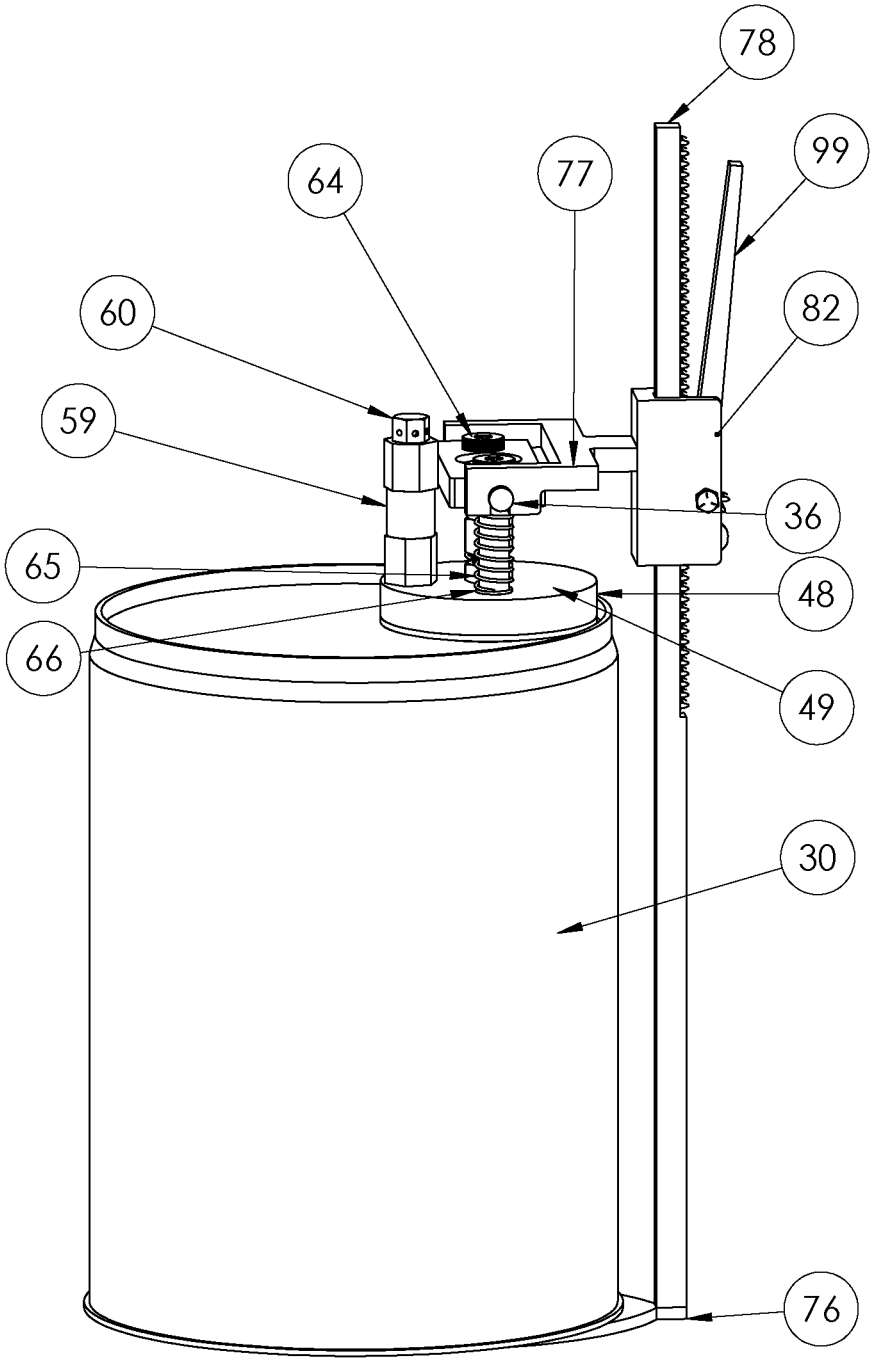
FIG. 16 is a side view photograph of the container clamping system in accordance with one embodiment of the present invention showing the handle in the open position.
Figure 17:
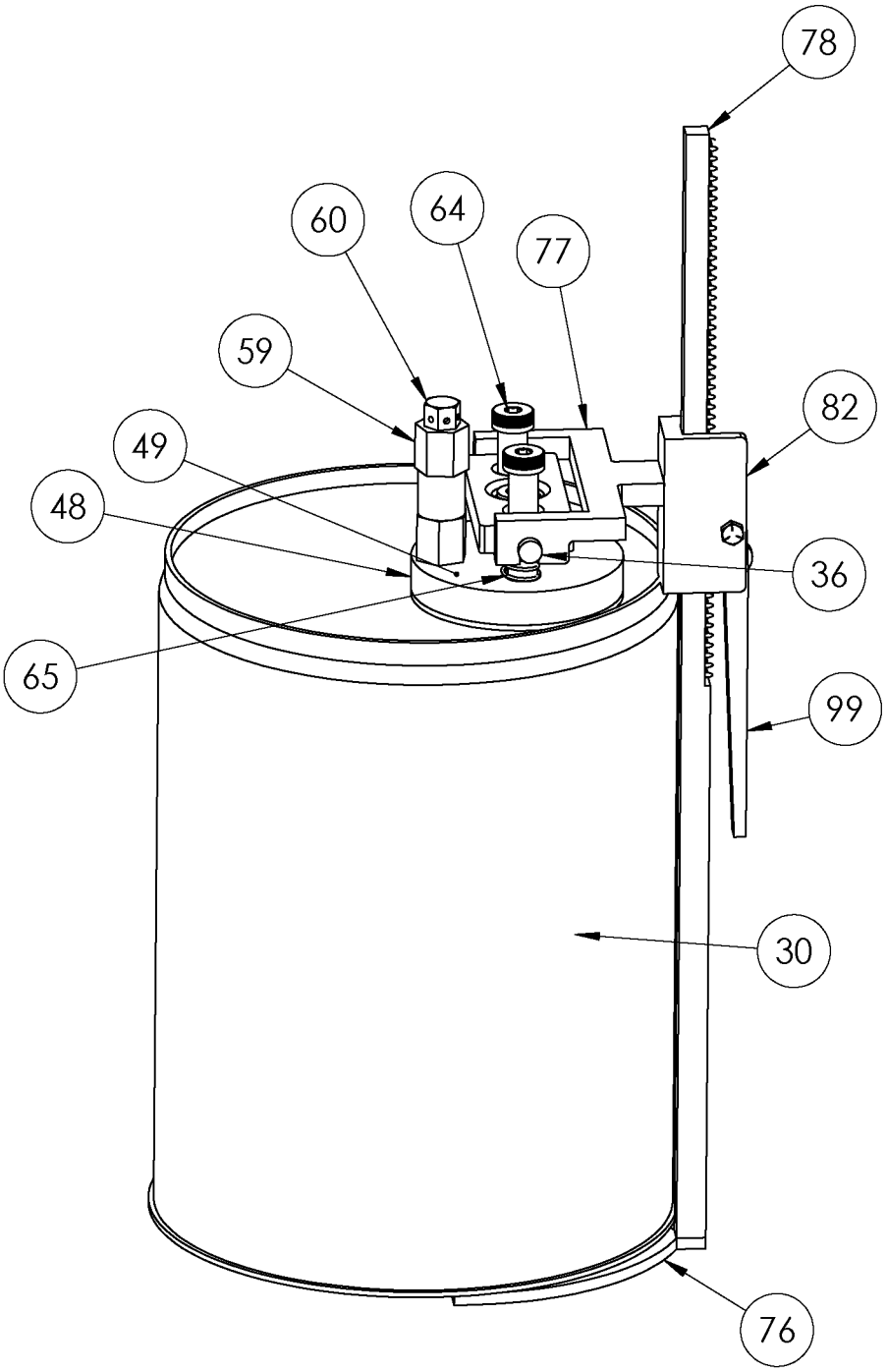
FIG. 17 is a side view photograph of the container clamping system in accordance with one embodiment of the present invention showing the handle in the closed position.

As illustrated in FIGS. 16 and 17, moving the handle 99 from the open to the closed position moves the top clamp arms 77 down which pushes the cap top 36 downward and compresses the springs 65, which exert a force through the Teflon washers 66 on the top surface 49 of the container cap 48 to form a positive seal around the discharge opening 32 (not shown in FIGS. 16 and 17). In the closed position, the compression of the springs 65 and hence the positive seal are maintained by the locking interaction between the snap hook 111 and the tab 102 on the handle 99.

A skilled reader will recognize that there are other systems of clamping the container 30 or 31 that can apply a downward force on the container cap 48 so as to create and maintain a seal between the container cap 48 and container 30 or 31, and that such can be used in accordance with the system of the present invention. For example, suitable solutions include a device that clamps around the rim or outside wall of the solvent container 30 or 31, devices that clamp on the inside rim of the container 30 or 31, or devices that grip the extruded section where the spout of the container 30 or 31 is attached.

Figure 31:
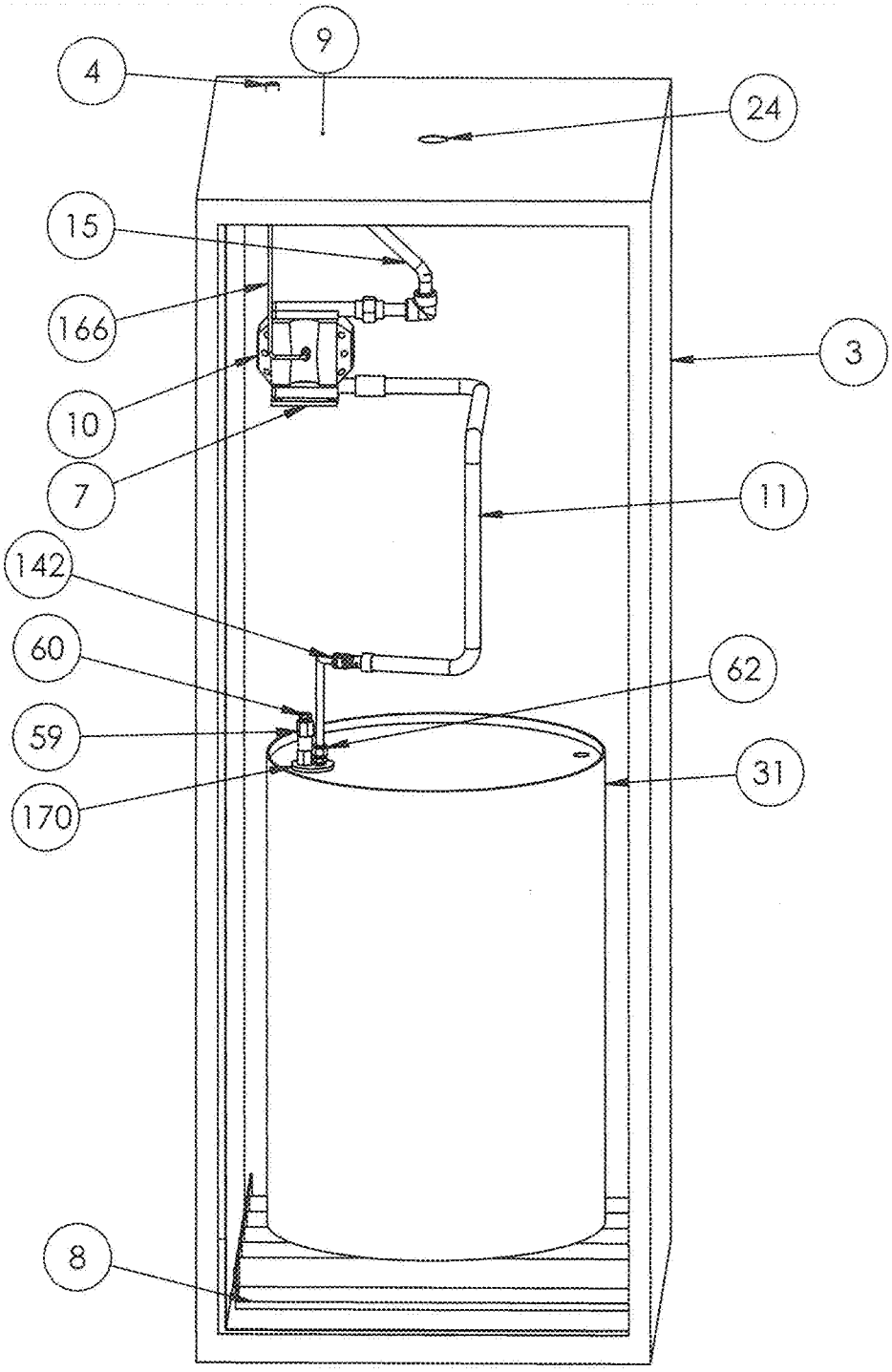
FIG. 31 is a perspective view of a drum storage cabinet in accordance with one embodiment of the present invention.
Figure 35:
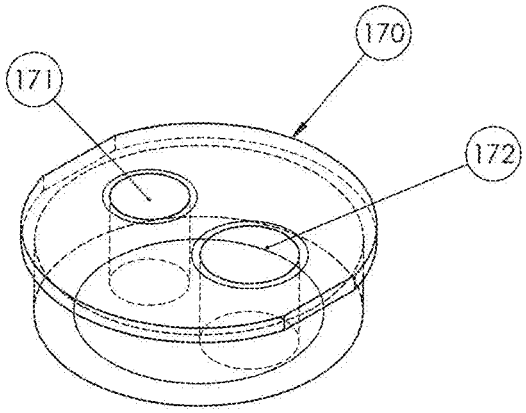
FIG. 35 is a hidden line view of a duplex bushing for use with a large container in accordance with one embodiment of the present invention.

In addition, a system may be provided with the present invention wherein the container cap-like device sealably screws directly into the discharge opening 32 of the solvent container 30 or 31. As illustrated in FIGS. 31 and 35, a duplex bushing 170 having a threaded breather port 171 and a threaded opening 172 is screwed into a threaded discharge opening 32 of a large container 31. A combination of the check valve 59 and a breather 60, previously described herein, is then screwed into the threaded breather port 171. A compression fitting 62, securing a tube 67, as previously described herein, is screwed into the threaded opening 172.

Figure 30:
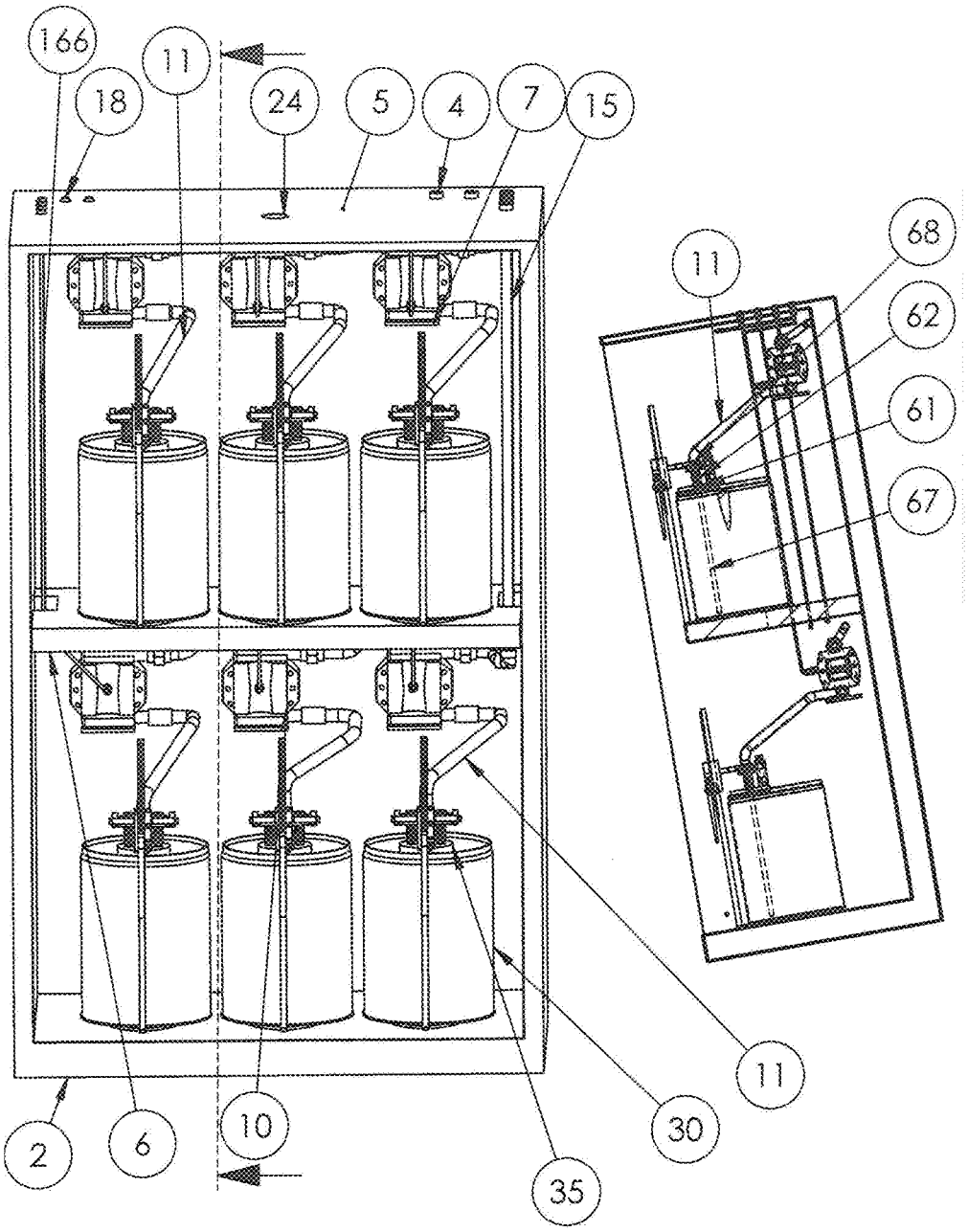
FIG. 30 is a perspective view of a storage cabinet in accordance with one embodiment of the present invention.

As illustrated in FIGS. 1, 30 and 31, the solvent containing containers 30 and 31 that are clamped in the clamping system 75 are located within fire and explosion rated flammable storage cabinets 2 and 3 respectively. In the embodiment illustrated in FIG. 1, the solvent storage system 1 of the present invention comprises two large storage cabinets 2 to house containers 30 which may be, for example, 6 liter, 20 liter, or 25 liter solvent containers (or any other container size that is suitable for use with the present invention), and one cabinet 3 to house a large container 31 which may be a 45 gallon drum, for example (or any other large container size that is suitable for use with the present invention). Cabinets 2 include shelves 6 for supporting containers 30 that are clamped in the clamping system 75. The shelves 6 are of strength and size sufficient to accommodate and support containers 30 and clamping systems 75.

Mounted inside cabinets 2 and 3 are also shelves 7 which support double diaphragm pumps 10.

The cabinet 3 for use with a 45 gallon drum has a roller system 8 for ease in loading and unloading the drum. As is known in the art, commercially available cabinets for use with 45 gallon drums are equipped with a roller system such as the roller system 8.

The number and size of the cabinets may vary depending on the size and number of containers 30 or 31 used as the source of solvent. In the embodiment illustrated in FIG. 1, three cabinets 2 and 3 hold a total of thirteen containers 30 and 31.

Mounted inside cabinets 2 and 3 are air-operated double-diaphragm pumps 10. Each air-operated double diaphragm pump 10 is mounted inside the cabinet 2 or 3 on shelf 7.

Installed in wall 5 of cabinets 2 and wall 9 of cabinet 3 are discharge line bulkhead fittings 4 for connecting section 15 of the solvent supply line 12 running inside the cabinets 2 or 3 with section 16 of the solvent supply line 12 running between the cabinets 2 and 3 and the fumehood 125. Also installed in the wall 5 of the cabinets 2 and wall 9 of cabinet 3 are air supply line bulkhead fittings 18 for connecting section 166 of the air supply line 164 running inside the cabinets 2 or 3 with section 167 of the air supply line 164 running outside the cabinets 2 and 3.

There is one discharge line bulkhead fitting 4 for each solvent supply line 12 and one air supply bulkhead fitting 18 for each air supply line 164. The discharge line bulkhead fittings 4 and the air supply bulkhead fittings 18 are welded into the wall 5 of the cabinets 2 and 3 and have threaded nipples that extend away from each surface of the wall 5 of the cabinets 2 and 3. Threaded nipples allow for connecting sections 15 and 16 of the solvent supply lines 12 to the discharge line bulkhead fittings 4 and for connecting sections 166 and 167 of the air supply line 164 to the air supply line bulkhead fittings 18.

Figure 29:
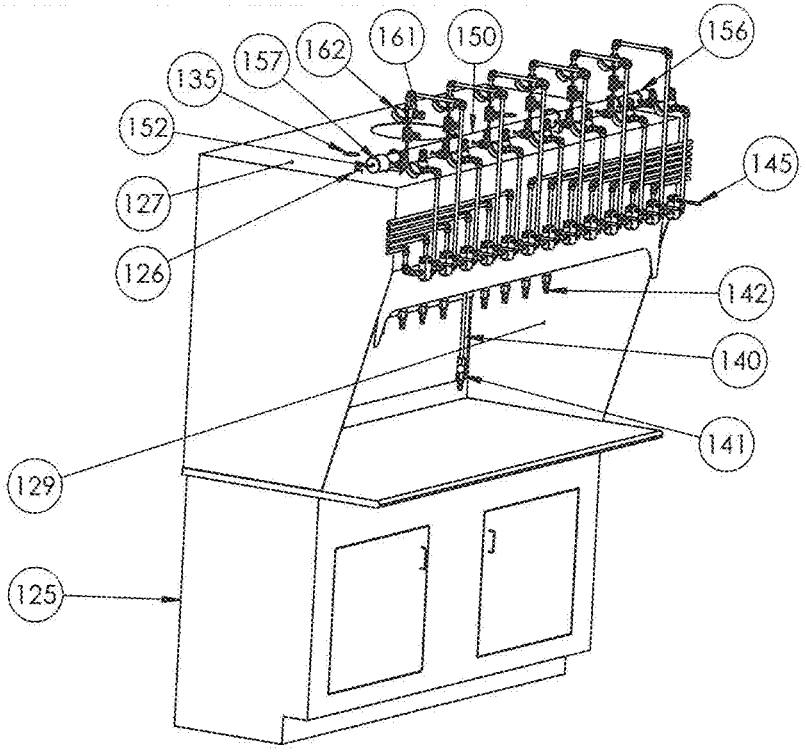
FIG. 29 is a perspective view of a fumehood in accordance with one embodiment of the present invention.

Each cabinet is coupled with and is vented to a fumehood 125 by way of air ducts 23 connected to ventilation suction connection ports 24 in wall 5 of cabinets 2 and wall 9 of cabinet 3 and ventilation ports 135 in the fumehood 125 as shown in FIG. 29. When the fumehood 125 is in operation, and the cabinet doors (not shown) are closed, negative pressure is created in the interior space of the cabinets 2 and 3 which draws out through air ducts 23 any solvent fumes that may escape containers 30 and 31.

Illustrated in FIGS. 1 and 29, the fumehood 125 provides an environment for the safe dispensing of solvents stored in the containers 30 and 31. The dispensing nozzles 140 are mounted inside the fumehood 125.

Figure 26:
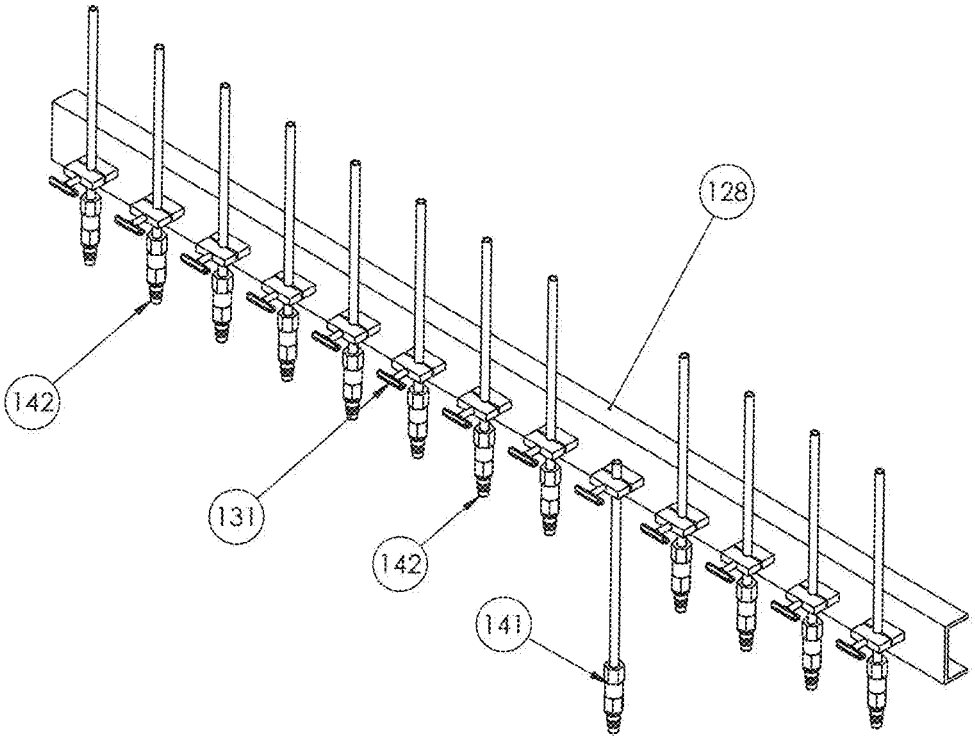
FIG. 26 is a perspective view of a dispensing nozzle in accordance with one embodiment of the present invention.
Figure 34:
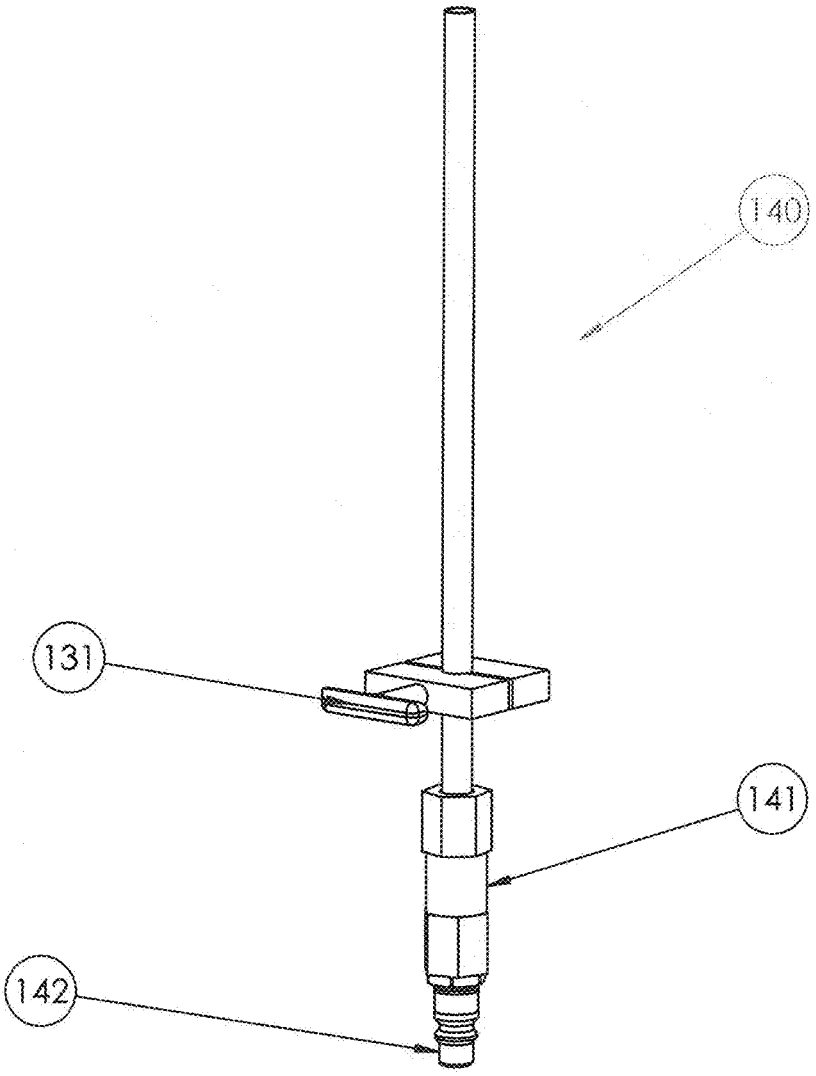
FIG. 34 is a perspective view of a dispensing nozzle in accordance with one embodiment of the present invention.

A rail 128 is installed on the inside of wall 129 of the fumehood 125 to allow for the attachment of the dispensing nozzles 140 by means of adjustable dispensing nozzle clamps 131. As illustrated in FIGS. 26 and 34, the dispensing nozzle 140 has an inline check valve 141 located adjacent a quick connect fitting 142 installed at the end of the dispensing nozzle 140. The inline check valve 141 ensures that no solvent escapes once the air-operated double diaphragm pump 10 is stopped. Preferably, the check valve 141 is a 1 psi valve.

A rail 130 is mounted along the front portion of the fumehood 125 to which the air directional control valves 145 are mounted using mounting holes built into each valve. The fumehood 125 has thirteen bulkhead fittings 126 installed in wall 127 for connecting solvent supply lines 12.

Figure 28:
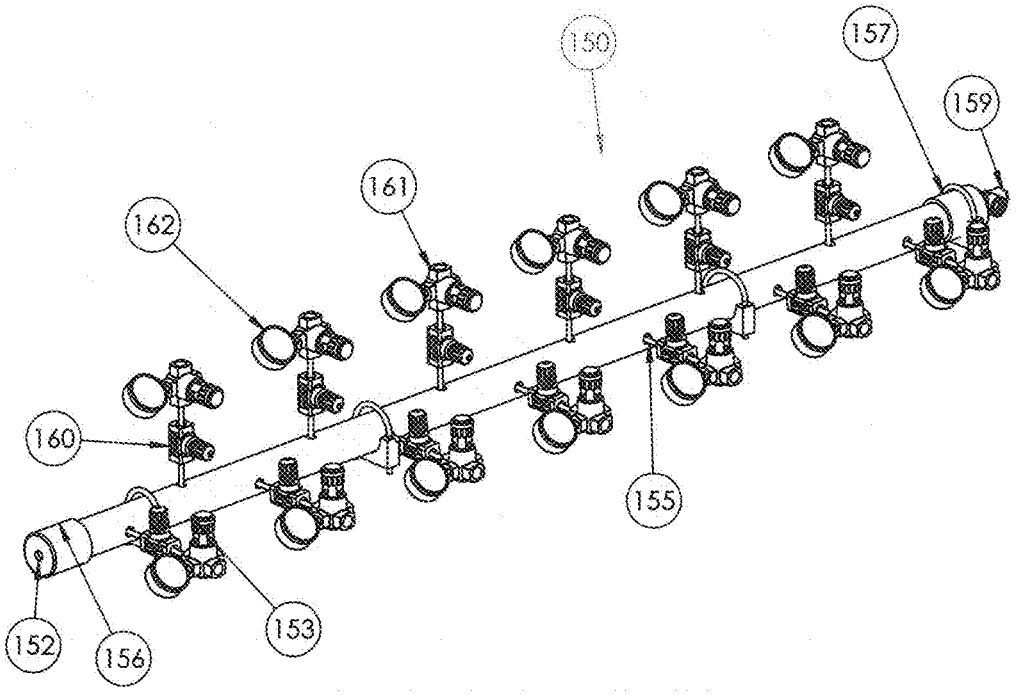
FIG. 28 is a perspective view of a manifold in accordance with one embodiment of the present invention.

The pressurized air used to power the air-operated double diaphragm pump 10 may be supplied from a main building compressor or from any other suitable source of compressed air 151. As illustrated in FIGS. 28 and 29, the pressurized air is fed into manifold 150 through an air entry port 152. The manifold 150 is constructed from a pipe 153, such as a schedule 80 pipe, or preferably, a schedule 120 pipe, having an internal passage 154, with thirteen holes drilled and tapped into the side of the pipe 153 forming air discharge ports 155 for connecting air supply lines 165 for each solvent. Using a schedule 120 pipe allows for fittings to be threaded into the discharge ports 155. Caps 156 and 157 are screwed around each end of the pipe 153. The cap 157 has a port into which a pressure relief valve 159 is screwed. The pressure relief valve 159 prevents the unwanted buildup of high air pressure in the system. The other cap 156 has an air entry point 152 through which pressurized air is fed. The air manifold 150 is mounted on top of the fumehood 125.

The air-operated double diaphragm pump 10 is used to pump solvent from the container 30 to the dispensing nozzle 140. As illustrated in FIG. 30, the sealing cap device 35 is coupled by way of the solvent supply line 11 with the air-operated double diaphragm pump 10. One end of the solvent supply line 11 is connected to the fitting 68. The other end of the solvent supply line 11 is connected to the pump 10.

As illustrated in FIGS. 1, 2, 30 and 31, each pump 10 is coupled with each dispensing nozzle 140 through the solvent supply lines 12. Sections 15 of the solvent supply lines 12 running inside the cabinets 2 or 3 connect to each pump 10 and each discharge line bulkhead fitting 4 on the inside of the cabinets 2 or 3. On the outside of the cabinets 2 or 3, on one end sections 16 of the solvent supply lines 12 are connected to each bulkhead fitting 4. On the other end, sections 16 of the solvent supply lines 12 are connected to each bulkhead fitting 126 on the outside of the fumehood 125. Connected to each bulkhead fitting 126 on the inside of the fumehood 125 are the first ends of sections 17 of the solvent supply lines 12. The other ends of sections 17 of the solvent supply lines 12 are connected to a dispensing nozzle 140. The connections to the nipples on discharge line bulkhead fittings 4 and bulkhead fittings 126 are sealed with Teflon tape to prevent the escape of vapours.

The solvent supply line 11 coupling the sealing cap device 35 to the pump 10 is preferably a stainless steel braided and Teflon flex line. The use of the flex line allows for the solvent containers to be moved out of the cabinet for change over, in that the use of flex line allows the user to move the container 30 or 31 before removing the clamping system 75 from the container. Accordingly, there is enough slack in the solvent supply line 11 to allow workers to pull the containers 30 or 31 out of the cabinets to do a container change over. In addition, the use of the flex line accounts for vibrations of the pump 10 while the pump is in operation.

Figure 36:
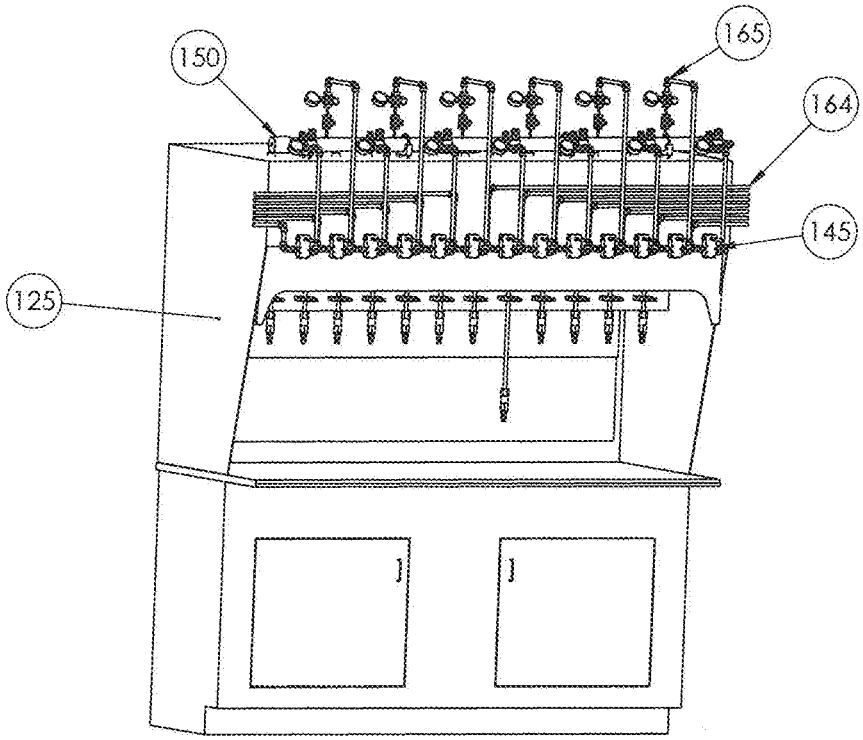
FIG. 36 is a perspective view of a fumehood in accordance with one embodiment of the present invention shown without rail showing air supply lines connecting air directional control valves with the air manifold.

The air-operated double diaphragm pump 10 is powered by pressurized air delivered to the manifold 150. Each air discharge port 155 is coupled by way of an air supply line 165 with a throttling valve 160, followed by a pressure regulator 161, and then the manually operated air directional control valve 145. The throttling valve 160 allows for the adjustability of the volume of air being supplied to the pump, whereas the pressure regulator 161 adjusts the pressure level of the supplied air to the system. The pressure regulator 161 is coupled to a pressure gauge 162. The manually operated air directional control valve 145 is inline and coupled by way of the air supply line 164 with the double diaphragm pump 10. Each air directional control valve 145 is also in line with the corresponding dispensing nozzle 140 mounted inside the fumehood 125. Air supply lines 165 are routed from the air manifold 150 to the air directional control valves 145 on the outside of the fumehood 125, as illustrated in FIG. 36. From the air directional control valves 145 air supply lines 164 are routed to the air supply line bulkhead fittings 18 mounted in the walls 5 of cabinets 2 and 3, and then to the double diaphragm pumps 10. The air supply lines 164 coupling each air-operated double diaphragm pump 10 with the corresponding air directional control valve 145 are flex lines.

Figure 27:
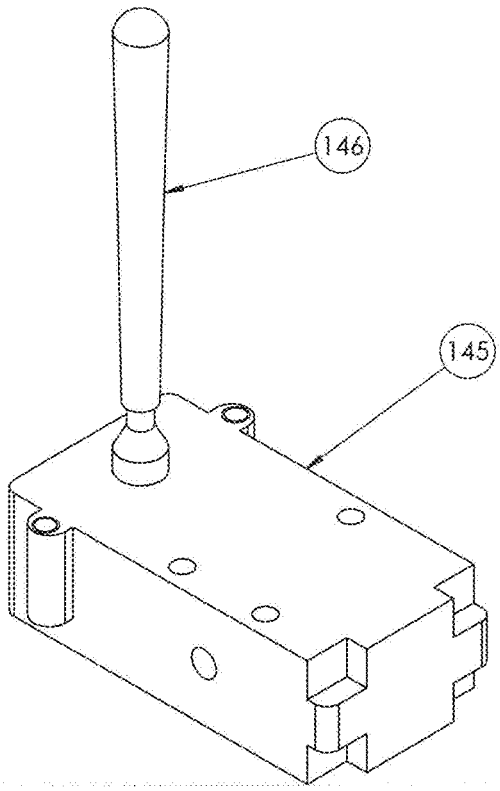
FIG. 27 is a perspective view of an air directional control valve in accordance with one embodiment of the present invention.

The air directional control valve 145 shown in FIG. 27 is a 3 way, 2 position, lever operated, spring return, normally closed directional control valve with exhaust to atmosphere. The air directional control valve is configured as follows. The air inlet is port 1, the air outlet to atmosphere is port 3, and port 2 is the air outlet to provide pressurized air to the pump 10. In the normally closed position, position 1, Port 1 is blocked meaning no compressed air can go through the valve. This means there is still air pressure in the air manifold waiting to be used. Port 2 and port 3 are connected in position 1. Any residual air pressure in the lines between the directional control valve 145 and the pump 10 is exhausted to the atmosphere via port 3. This ensures the pump 10 will not operate without the lever 146 being pulled. In position 2, i.e., the on position, port 1 is connected to port 2 allowing compressed air to flow from the air manifold through the valve and then to the pump to start doing work. In this position port 3 is blocked. Once the user lets go of the lever 146 operating the directional control valve 145 an internal spring pulls the valve back into its original position, position 1. In this position port 1 is blocked, and the air in the lines between the directional control valve and the pump is exhausted to atmosphere through port 3.

The desired pumping rate of the solvent is controlled as follows. The air pressure and flow rates are first set by the throttling valve 160 and pressure regulator 161. The lever 146 on the directional control valve 145 allows a user to slowly/partially open the directional control valve 145, or slowly close the valve. Depending on how far the lever 146 is pulled a varying rate of air will flow through the valve supplying a varying rate of air to the pump. In addition, each solvent has its own air pressure regulator and air throttling valve. These two pieces of instrumentation allow for full control to each directional control valve. Each set of pressure regulators and throttling valve will be adjusted for each solvent to optimize the solvent flow. The air regulator coupled with the throttling valve and directional control valve gives the operator the ability to fully control the flow of each solvent.

A skilled reader will recognize that almost any other type of air directional control valve may be used with the present invention, but the best option is a normally closed, spring return valve to allow the pumps 10 to be shut off automatically when the valve is not activated by the user. A skilled reader will also recognize that a peristaltic pump, along with other pump types, may be used in place of the double diaphragm pump, but the use of a peristaltic pump is less desirable than the use of a double diaphragm pump with the system of the present invention.

The system of the present invention in respect to various embodiments offers various advantages relating to the risks of handling harmful and combustible materials, in that with the use of the system of the present invention the risk of solvent spills, escape of harmful and flammable solvent fumes, contact with solvent and solvent fumes, and/or ignition or explosion of solvent or solvent fumes can be minimized in accordance with the embodiment of the present invention being implemented.

To illustrate advantages that may be achieved with the system of the present invention, in one aspect a lack of electrical components in the system of the present invention eliminates the risk of power usage around volatile and flammable solvents, thereby decreasing the risk of ignition of volatile fumes and solvents. In another aspect, the storage containers used with the system of the present invention are stored in explosion and fire rated storage cabinets that are vented into a fumehood, where any escaping fumes may be safely vented away from the cabinet and the user environment. In yet another aspect, the risk of escape of toxic fumes and explosion is reduced by locating the dispensing nozzles in a fumehood, where any escaping fumes can similarly be vented off. Additionally, placing most of the components of the system in the storage cabinets and the fumehood, each of which may be grounded to eliminate a build-up of static electricity, allows all metal components of the system to be grounded, which further decreases a risk of spark that might ignite solvents or solvent fumes. In another aspect, the system allows a user to dispense multiple solvents from a single location in a safe environment.

Another advantage that may be achieved with the system of the present invention is that the system uses off-the-shell storage containers as the source of solvents to be dispensed and as such the system does not require special packaging.

A reader knowledgeable in the field to which this invention relates will understand that various components of the system may be substituted and the configuration of the system may be changed without affecting the principle of the operation of the present invention.

We claim:

1. A solvent dispensing system comprising:

a manifold for supplying pressurized air, said manifold comprising an internal passage, an air entry port in communication with the internal passage, and at least one air discharge port in communication with the internal passage;

at least one selectively controllable air directional control valve, each said at least one selectively controllable air directional control valve in communication with one of the at least one air discharge port;

at least one air-operated double diaphragm pump, each said air-operated double diaphragm pump in communication with one of the at least one selectively controllable air directional control valve;

at least one solvent container connecting means adapted for establishing a sealed constant pressure fluid communication between one of at least one solvent container and one of the at least one air-operated double diaphragm pump;

at least one solvent dispensing nozzle, each said solvent dispensing nozzle in fluid communication with one of the at least one air-operated double diaphragm pump;

at least one solvent supply line, each said solvent supply line in a first section connecting one of the at least one solvent container connecting means with one of the at least one air-operated double-diaphragm pump, and in a second section connecting one of the at least one air operated double diaphragm pump with one of the at least one dispensing nozzle;

at least one air supply line, each said air supply line in a first section connecting one of the at least one air discharge port with one of the at least one air directional control valve, and in a second section connecting one of the at least one air directional control valve with one of the at least one air-operated double diaphragm pump;

at least one storage cabinet adapted for storing the at least one solvent container, each said storage cabinet comprising the at least one air-operated double diaphragm pump; and a fumehood comprising the at least one dispensing nozzle for dispending solvents, wherein each air-operated double diaphragm pump is associated with one air directional control valve and is powered by pressurized air passing from the air manifold through the air directional control valve to the air-operated double diaphragm pump, and wherein upon activation of a particular air-operated double diaphragm pump, solvent passes from a corresponding container to the air-operated double diaphragm pump, and then to a corresponding dispensing nozzle;

wherein the at least one solvent container connecting means comprises a sealing cap device comprising:

a container cap having a top and bottom surface, breather port and an opening;

a cap top attached to the top surface of the container cap through at least one resilient spacer means;

a check valve in communication with a breather, said check valve coupled to the breather port; and a tube secured in the opening in the container cap and extending away from the bottom and top surface of the container cap;

wherein the sealing cap device forms a seal around a discharge opening of the at least one solvent container between the top surface of the at least one solvent container and the bottom surface of the container cap upon an application to the cap top of a force sufficient to compress the at least one resilient spacer means.

2. The solvent dispensing system of claim 1, further comprising at least one container clamping system, the at least one container clamping system comprising:

a vertical bar having an upper portion and a bottom portion along its longitudinal axis, comprising a gear rack along the upper portion of the vertical bar;

a handle clamp assembly comprising:

a body in slideable engagement with the vertical bar along the portion containing the gear rack;

a handle having a toothed pinion portion and a handle portion, the toothed pinion portion being rotatably mounted in the body of the handle clamp assembly, and in meshed engagement with the gear rack, wherein the handle is movable between an open and closed position, and wherein in the open position, the handle clamp assembly is at a first position along the vertical bar, and as the handle is moved to the closed position, the meshing of the pinion and gear rack causes the handle clamp assembly to move down the vertical bar to the second position;

a means for securing the handle in the closed position; and a top clamping means;

a foot connected to the bottom portion of the vertical bar, wherein the foot and the clamping means are adapted to apply a clamping force to an object there between;

wherein the at least one container clamping system in the closed position applies a clamping force between the bottom of the container and the cap top so as to compress the at least one resilient spacer means and form a seal around the opening of the container between the top surface of the container and the bottom surface of the sealing cap device.

* * * * *